US005751331A

United States Patent [19]

Higuchi et al.

[11] Patent Number: 5,751,331

[45] Date of Patent: May 12, 1998

[54] INK SHEET TRANSFER CONTROL APPARATUS FOR GIVING A SPECIFIED VALUE OF TENSION TO INK SHEET TO IMPLEMENT STABLE TRANSFER

[75] Inventors: Kaoru Higuchi, Tenri; Hiroshi Ishii, Kashihara; Hiroyuki Hanato, Nara, all of Japan

[73] Assignee: Sharp Kabushiki Kaisha, Osaka, Japan

[21] Appl. No.: 463,770

[22] Filed: Jun. 5, 1995

[30] Foreign Application Priority Data

Jul. 4, 1994 [JP] Japan ..... 6-152290

[51] Int. Cl.[6] ..... B41J 17/28; B41J 17/30; B41J 2/325; B41J 33/14

[52] U.S. Cl. ..... 347/217

[58] Field of Search ..... 347/217, 219; 400/234, 618; 242/410, 412, 412.1; 226/10, 24, 27, 42

[56] References Cited

U.S. PATENT DOCUMENTS 5,370,470 12/1994 Kim ..... 400/234

FOREIGN PATENT DOCUMENTS 4-201573 7/1992 Japan .
5-60195 8/1993 Japan .
5-270088 10/1993 Japan .

*Primary Examiner*—Benjamin R. Fuller
*Assistant Examiner*—L. Anderson

[57] ABSTRACT

The invention provides an ink sheet transfer control apparatus which can transfer an ink sheet stably without requiring any complex structure. A CPU drives and controls a grid motor so that recording paper can be transferred at a constant speed with the ink sheet and the recording paper pressed in contact with each other by a thermal head and a platen. Then, the CPU drives an ink motor with an arbitrarily determined voltage Vi, and measures a current Ig then flowing through the grid motor. The CPU determines such an optimum drive voltage Vir of the ink motor that a specified tension is developed to the ink sheet in printing operation, based on the measured current Ig, and drives the ink motor with the optimum drive voltage Vir. Characteristics of print drive system are detected by measuring the current Ig flowing through the grid motor, so that the print drive system can be controlled with simple construction.

21 Claims, 7 Drawing Sheets

INK SHEET TRANSFER CONTROL APPARATUS FOR GIVING A SPECIFIED VALUE OF TENSION TO INK SHEET TO IMPLEMENT STABLE TRANSFER

BACKGROUND OF THE INVENTION

1. Field of the Invention

The present invention relates to an ink sheet transfer control apparatus contained in a thermal transfer printer that produces prints on recording paper with the use of ink sheets.

2. Description of the Prior Art

In a printer of the thermal transfer system, as shown in FIG. 10, a platen 107 is disposed on the ink-applying surface side of an ink sheet 108 so as to be opposed to a thermal head 103. The platen 107 sandwiches and supports the ink sheet 108 and recording paper 109 together with the thermal head 103. The thermal head 103 has a plurality of heating elements arrayed thereon.

With this arrangement, the ink sheet 108 and the recording paper 109 are sandwiched and supported by the thermal head. 103 and the platen 107. Moreover, the ink sheet 108 and the recording paper 109 are pressed against each other with an appropriate pressure applied thereto. The recording paper 109 is transferred in the printing this process, the thermal head 103 has electrical energy applied thereto based on recording information, so that the heating elements, which are resistors, generate heat by electrical-to-thermal energy conversion. As a result, the ink on the ink sheet 108 is fused or sublimed, whereby the ink is transferred onto the recording paper 109.

For this process, the recording paper 109 is transferred at a constant speed by the grid roller 105 driven by the recording paper transfer motor 106 (hereinafter, referred to as grid motor 106). Accordingly, the ink sheet 108 is required to have an appropriate tension.

Besides, although the transfer of the ink sheet 108 is aided by the transfer of the recording paper 109, the ink sheet 108 needs to be rolled up by the winding roll 102 driven by an ink sheet transfer motor 101 (hereinafter, referred to as ink motor 101) in order to overcome both the friction force developed between the ink sheet 108 and the thermal head 103 and tension on the feed roll side.

In this connection, if the tension of the ink sheet 108 is too strong, the running speed of the ink sheet 108 exceeds that of the recording paper 109. This causes the ink sheet 108 to affect the transfer speed of the recording paper 109 such that not only the print grade may be incurred but also the ink sheet 108 may break in the worst case (maximum tension: Fmax).

Conversely, if the tension of the ink sheet 108 is too weak, the ink sheet 108 may involve looseness that may form wrinkles of the ink sheet 108 in printout, such that the print grade may be deteriorated (minimum tension: Fmin).

Thus, a constant torque mechanism 117 is incorporated in the winding roll 102 so that the winding roll 102 is driven at an optional constant torque.

However, the tension $F_1$ applied to the ink sheet 108 is such that $F_1=T/r$ (where T is the torque of the winding roll and r is the roll diameter). Accordingly, as the ink sheet 108 is progressively wound, the roll diameter of the winding roll 102 increases so that the tension $F_1$ of the ink sheet 108 changes from $T/r_0$ at the winding start ($r_0$) to T/rn at the winding end of the ink sheet 108.

It is necessary to set the fluctuation of the tension of the ink sheet 108 due to the winding radius within such a range as would not affect the print grade ($Fmin<F_1<Fmax$). There would be a danger, however, that the fluctuation may enter the range that affects the print grade, depending on characteristic changes due to environmental changes.

Also, the more the ink sheet 108 is wound around a feed roll 104 to increase the efficiency of the ink cassette, so the fluctuation of tension of the ink sheet 108 due to the winding also increases. This poses another problem that the aforementioned danger may grow further.

Thus, in order to solve the above problems, there have conventionally been proposed various methods. In one example of them, a pulse generator is provided in a drive system for the winding roll in synchronism with the drive system. The winding radius of the ink sheet is calculated based on the pulse generated by the pulse generator and the winding roll is given a drive force appropriate for the calculated winding radius. In this way, the tension fluctuation of the ink sheet due to a change in the winding radius of the ink sheet is corrected so that tension fluctuation is controlled so as to be suppressed (Japanese Utility Model Laid-Open Publication No. HEI 5-60195).

However, the above conventional method necessitates a pulse generator, incurring a drawback of complex structure.

Also, the above conventional method has been provided with no preparations for load fluctuations of the motor due to environmental changes and deterioration of the motor itself.

SUMMARY OF THE INVENTION

The present invention has been developed with a view to substantially solving the above described disadvantages and has for its essential object to provide an ink sheet transfer control apparatus capable of giving a specified value of tension to ink sheet to implement stable transfer without requiring any complex structure, and therefore to enhance the print grade.

In order to achieve the aforementioned object, there is provided an ink sheet transfer control apparatus having a print head for transferring ink applied to an ink sheet onto recording paper, a platen disposed to be opposed to the print head and serving for supporting the ink sheet and the recording paper by sandwiching them between itself and the print head, ink sheet transfer means for transferring the ink sheet by winding up the ink sheet, and recording paper transfer means for transferring the recording paper, the ink sheet transfer means including a ink sheet transfer DC (Direct Current) motor, and the recording paper transfer means including a recording paper transfer DC motor, the ink sheet transfer control apparatus comprising:

first control means for controlling the recording paper transfer means so that the recording paper is transferred at a constant speed with the ink sheet and the recording paper pinched by the print head and the platen into press contact with each other;

measuring means for measuring a recording paper drive voltage with which the first control means is driving and controlling the recording paper transfer DC motor or a recording paper transfer motor current flowing through the recording paper transfer DC motor, when the ink sheet transfer DC motor is driven with a specified ink sheet drive voltage;

relational expression determining means for determining such a relational expression between the ink sheet drive voltage and the recording paper drive voltage or the recording paper transfer motor current that a specified tension is developed to the ink sheet, from the specified ink sheet drive voltage with which the ink sheet transfer DC motor is driven, and a recording paper drive voltage or recording paper transfer motor current with which the recording paper transfer DC motor is driven; and second control means for substituting a predetermined target recording paper drive voltage or recording paper transfer motor current into the relational expression, to thereby calculate such an ink sheet drive voltage that the recording paper transfer DC motor is driven with the target recording paper drive voltage or such an ink sheet drive voltage that the target recording paper transfer motor current is made to flow through the recording paper transfer DC motor, whereby the ink sheet transfer DC motor is driven with the calculated ink sheet drive voltage.

In the above arrangement, since the ink sheet and the recording paper are sandwiched by the print head and the platen into press contact with each other, the ink sheet and the recording paper are transferred integrally by the sum of the driving force of the recording paper transfer means and the driving force of the ink sheet transfer means.

The first control means controls the recording paper transfer means so that the recording paper is transferred at a constant speed.

Therefore, for example when the tension of the ink sheet has become smaller due to an increase in the winding radius of the ink sheet or an environmental change, the first control means increases the driving force of the recording paper transfer means so that the recording paper is transferred at a constant speed.

In other words, the first control means changes the driving force of the recording paper transfer means in response to the driving force generated by the ink sheet transfer means so that the recording paper is transferred at a constant speed.

The present invention is conditioned by this arrangement, and effectively utilizes this arrangement to control the ink sheet transfer means.

In the present invention, when the ink sheet transfer DC motor is driven with a specified ink sheet drive voltage, the measuring means first measures either a recording paper drive voltage with which the first control means drives and controls the recording paper transfer DC motor, or a recording paper transfer motor current flowing through the recording paper transfer DC motor. Then, the relational expression determining means determines such a relational expression between the ink sheet drive voltage and the recording paper drive voltage that a specified tension is developed to the ink sheet, from the specified ink sheet drive voltage and the recording paper drive voltage or recording paper transfer motor current. Further, the second control means substitutes a predetermined target recording paper drive voltage or recording paper transfer motor current into the relational expression, to thereby calculate such an ink sheet drive voltage that the recording paper transfer DC motor is driven with the target recording paper drive voltage or that the target recording paper transfer motor current is made to flow through the recording paper transfer DC motor. As a result, the ink sheet transfer DC motor is driven with the calculated ink sheet drive voltage.

In other words, in the present invention, from a specified ink sheet drive voltage and a recording paper drive voltage or recording paper transfer motor current measured in correspondence to the specified ink sheet drive voltage, such a relational expression that a specified tension is developed to the ink sheet is determined. Then, a desired target drive voltage or current of the recording paper transfer DC motor is substituted into the relational expression, whereby an ink sheet drive voltage to be applied to the ink sheet transfer DC motor is calculated.

As seen above, in the present invention, such a relational expression that a specified tension is developed to the ink sheet is determined by measuring a recording paper drive voltage or recording paper transfer motor current corresponding to a specified ink sheet drive voltage. Then, based on the relational expression, an ink sheet drive voltage corresponding to a target recording paper transfer DC motor drive voltage or recording paper transfer motor current can be derived. Therefore, the tension of the ink sheet can be set to a specified value without requiring any complex structure as in pulse generators, so that the ink sheet can be transferred stably and therefore the print grade can be improved.

Also, there is provided an ink sheet transfer control apparatus having a print head for transferring ink applied to an ink sheet onto recording paper, a platen disposed to be opposed to the print head and serving for supporting the ink sheet and the recording paper by sandwiching them between itself and the print head, ink sheet transfer means for transferring the ink sheet by winding up the ink sheet, and a recording paper transfer means for transferring the recording paper, the ink sheet transfer means including a ink sheet transfer DC motor, and the recording paper transfer means including a recording paper transfer DC motor, the ink sheet transfer control apparatus comprising:

first control means for controlling the recording paper transfer means so that the recording paper is transferred at a constant speed with the ink sheet and the recording paper pinched by the print head and the platen into press contact with each other;

first measuring means for measuring a first recording paper current flowing through the recording paper transfer DC motor driven and controlled by the first control means, when the ink sheet transfer motor is driven with a specified first ink sheet drive voltage;

second measuring means for measuring a second recording paper current flowing through the recording paper transfer DC motor driven and controlled by the first control means, when the ink sheet transfer DC motor is driven with a specified second ink sheet drive voltage;

relational expression determining means for determining such a relational expression between the ink sheet drive voltage and the recording paper current that a specified tension is developed to the ink sheet, from the first and second ink sheet drive voltages and the first and second recording paper currents; and second control means for substituting a predetermined target recording paper drive voltage into the relational expression, to thereby calculate such an ink sheet drive voltage that the recording paper transfer DC motor is driven with the target recording paper drive voltage, whereby the ink sheet transfer DC motor is driven with the calculated ink sheet drive voltage.

According to this ink sheet transfer control apparatus, when the ink sheet transfer DC motor is driven with a specified first ink sheet drive voltage, the first measuring means measures a first recording paper current flowing through the recording paper transfer DC motor controlled by the first control means. Next, when the ink sheet transfer DC motor is driven with a second ink sheet drive voltage, the second measuring means measures a second recording paper current flowing through the recording paper transfer DC motor controlled by the first control means. Then, the relational expression determining means determines such a relational expression between the ink sheet drive voltage and the recording paper current that a specified tension is developed to the ink sheet, from the first and second ink sheet drive voltages and the first and second recording paper currents. Further, the second control means substitutes a predetermined target recording paper drive voltage or recording paper current into the relational expression, to thereby calculate such an ink sheet drive voltage that the recording paper transfer DC motor is driven with the target recording paper drive voltage or that the target recording paper current is made to flow through the recording paper transfer DC motor. As a result, the ink sheet transfer DC motor is driven with the calculated ink sheet drive voltage.

In other words, in this ink sheet transfer control apparatus, such a relational expression that a specified tension is developed to the ink sheet is determined from the first and second ink sheet drive voltages and the first and second recording paper currents measured in correspondence to the first and second ink sheet drive voltages. Then, a desired target recording paper drive voltage or recording paper current is substituted into the relational expression, whereby an ink sheet drive voltage to be applied to the ink sheet transfer DC motor is calculated.

As seen above, in this ink sheet transfer control apparatus, such a relational expression that a specified tension is developed to the ink sheet is determined by measuring two recording paper currents corresponding to specified two different ink sheet drive voltages. Then, based on the relational expression, the ink sheet drive voltage corresponding to a target recording paper drive voltage or a target recording paper current can be calculated. Therefore, the tension of the ink sheet can be set to a specified value without requiring any complex structure as in pulse generators, so that the ink sheet can be transferred stably and therefore the print grade can be improved.

Also, in this ink sheet transfer control apparatus, since the target driving force of the recording paper transfer DC motor is calculated from the current flowing through the recording paper transfer DC motor, the target driving force of the recording paper transfer DC motor can be calculated without being affected by any deterioration of the recording paper transfer DC motor. Therefore, according to this ink sheet transfer control apparatus, the ink sheet can be transferred stably even if the recording paper transfer DC motor has deteriorated, so that the print grade can be maintained good.

Furthermore, there is provided an ink sheet transfer control apparatus having a print head for transferring ink applied to an ink sheet onto recording paper, a platen disposed to be opposed to the print head and serving for supporting the ink sheet and the recording paper by sandwiching them between itself and the print head, ink sheet transfer means for transferring the ink sheet by winding up the ink sheet, and recording paper transfer means for transferring the recording paper, the ink sheet transfer means including a ink sheet transfer DC motor, and the recording paper transfer means including a recording paper transfer DC motor, the ink sheet transfer control apparatus comprising:

first control means for controlling the recording paper transfer means so that the recording paper is transferred at a constant speed with the ink sheet and the recording paper pinched by the print head and the platen into press contact with each other;

first measuring means for measuring a first recording paper drive voltage with which the first control means is driving and controlling the recording paper transfer DC motor and a first recording paper transfer current flowing through the recording paper transfer DC motor, when the ink sheet transfer DC motor is driven with a specified first ink sheet drive voltage;

deterioration constant calculating means for calculating a deterioration constant of the recording paper transfer DC motor from the first recording paper drive voltage and the first recording paper current;

target recording paper drive voltage correcting means for correcting a predetermined target recording paper drive voltage by an extent corresponding to a deterioration of the DC motor represented by the deterioration constant;

second measuring means for measuring a second recording paper drive voltage with which the first control means is driving and controlling the recording paper transfer DC motor, when the ink sheet transfer DC motor is driven with a specified second ink sheet drive voltage;

relational expression determining means for determining such a relational expression between the ink sheet drive voltage and the recording paper drive voltage that a specified tension is developed to the ink sheet, from the first and second ink sheet drive voltages and the first and second recording paper drive voltages; and second control means for substituting the target recording paper drive voltage corrected by the target recording paper drive voltage correcting means, into the relational expression determined by the relational expression determining means, to thereby calculate such an ink sheet drive voltage that the recording paper transfer DC motor is driven with the corrected target recording paper drive voltage, whereby the ink sheet transfer DC motor is driven with the calculated ink sheet drive voltage.

Also, in this ink sheet transfer control apparatus, with the ink sheet and the recording paper sandwiched by the print head and the platen into press contact with each other, while the first control means is controlling the recording paper transfer DC motor so that the recording paper is transferred at a constant speed, the first measuring means drives the ink sheet transfer DC motor with a specified first ink sheet drive voltage. Then, during this operation, the first measuring means measures a first recording paper drive voltage with which the first control means is driving and controlling the recording paper transfer DC motor, and a first recording paper current flowing through the recording paper transfer DC motor. Further, the deterioration constant calculating means calculates a deterioration constant of the recording paper transfer DC motor from the first recording paper drive voltage and the first recording paper current. Then, the recording paper drive voltage calculating means corrects the target value of the recording paper drive voltage, i.e., the target recording paper drive voltage, by an extent corresponding to the deterioration of the DC motor, which is a recording paper transfer means, represented by the deterioration constant. The second measuring means drives the ink sheet transfer DC motor with a specified second ink sheet drive voltage and measures a second recording paper drive voltage. Then, the relational expression determining means determines such a relational expression between the ink sheet drive voltage and the recording paper drive voltage that a specified tension is developed to the ink sheet, from the first and second ink sheet drive voltages and the first and second recording paper drive voltages. Then, the second control means substitutes the corrected target recording paper drive voltage into the relational expression to thereby calculate such an ink sheet drive voltage that the recording paper transfer DC motor is driven with the corrected target recording paper drive voltage. As a result, the second control means drives the ink sheet transfer DC motor with the resulting ink sheet drive voltage.

As seen above, in this ink sheet transfer control apparatus, such a relational expression that a specified tension is developed to the ink sheet is determined by measuring two recording paper drive voltages corresponding to specified two different ink sheet drive voltages, and based on the relational expression, the ink sheet drive voltage corresponding to a target recording paper drive voltage can be calculated. Therefore, the tension of the ink sheet can be set to a specified value without requiring any complex structure as in pulse generators, so that the ink sheet can be transferred stably and therefore the print grade can be improved. Also, in this ink sheet transfer control apparatus, since the target recording paper drive voltage is corrected by detecting a deterioration of the recording paper transfer DC motor, the ink sheet can be transferred stably at all times in response to any deterioration of the recording paper transfer DC motor.

Further, the first control means controls the recording paper transfer DC motor generally by controlling the drive voltage of the recording paper transfer DC motor. Accordingly, the drive voltage of the recording paper transfer DC motor can be measured with simplicity and high accuracy. As a result, the measurement of the drive voltage of the recording paper transfer DC motor, which is performed for calculating an optimum ink sheet transfer DC motor drive voltage as in this ink sheet transfer control apparatus, can be accomplished with simplicity and high accuracy. Accordingly, the accuracy of calculating the optimum ink sheet drive voltage can be improved.

Further, in one embodiment, with the recording paper and the ink sheet out of press contact with each other, when the recording paper transfer DC motor is driven with a specified voltage, the current measuring means measures the current flowing through the recording paper transfer DC motor at that time. Then, the recording paper transfer force calculation-formula correcting means detects a change in the transfer ability of the driving force transfer system contained in the recording paper transfer means, based on the current value measured by the current measuring means, and corrects the calculation formula for calculating the transfer force of the recording paper transfer means from the recording paper drive voltage or the recording paper current, in response to the change in the transfer ability. Further, the relational expression determining means determines such a relational expression between the ink sheet drive voltage and the recording paper drive voltage that a specified tension is developed to the ink sheet, or such a relational expression between the ink sheet drive voltage and the recording paper current that a specified tension is developed to the ink sheet, by using the calculation formula corrected by the recording paper transfer force calculation-formula correcting means. Therefore, according to this embodiment, at all times a specified tension can be developed to the ink sheet in correspondence to a change in the transfer ability of the driving force transfer system contained in the recording paper transfer means, so that a stable transfer of the ink sheet can be accomplished.

In one embodiment, the first recording paper current and a target recording paper current corresponding to a predetermined target recording paper transfer force are compared with each other. Then, the second measuring means is controlled in such a way that if the first recording paper current is greater than the target recording paper current, then the second ink sheet drive voltage is set larger than the first ink sheet drive voltage, and that if the first recording paper current is smaller than the target recording paper current, then the second ink sheet drive voltage is set smaller than the first ink sheet drive voltage. Therefore, according to this embodiment, the measured first recording paper current can be utilized in setting the second ink sheet drive voltage. That is, according to this embodiment, the second ink sheet drive voltage can be made closer to the optimum ink sheet drive voltage than the first ink sheet drive voltage can. As a result, according to this embodiment, until the optimum driving force for the ink motor is calculated, the ink sheet can be prevented from being transferred unstably.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinbelow, the ink sheet transfer control apparatus of the present invention is described in detail based on embodiments illustrated in the accompanying drawings.

Figure 1:
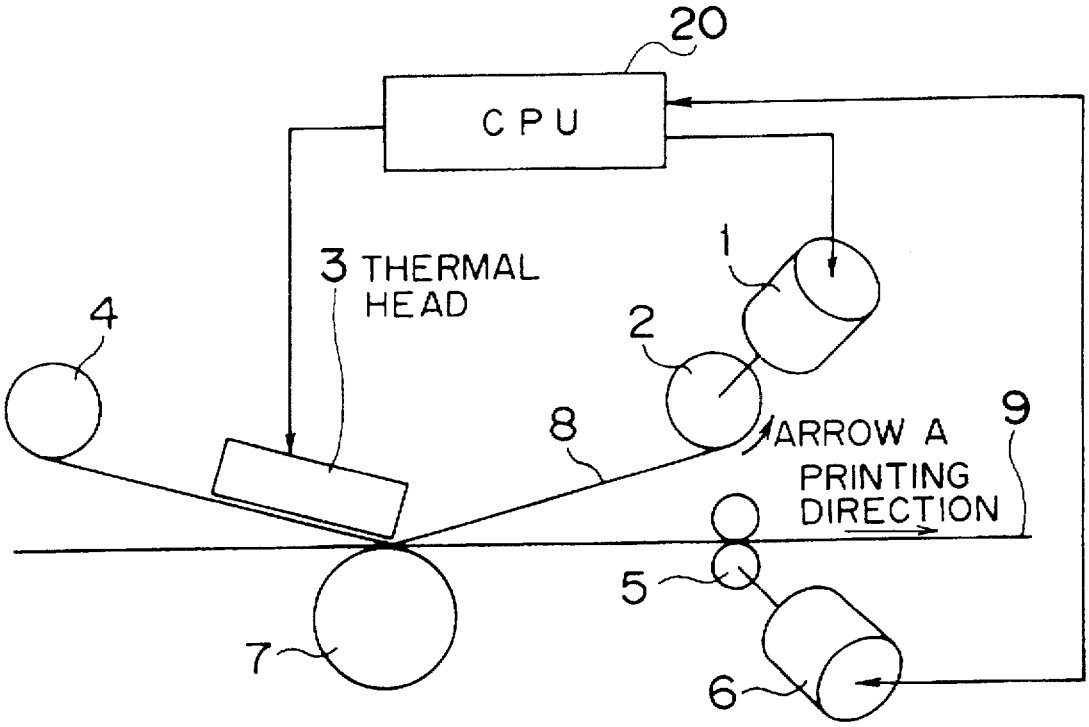
FIG. 1 is an arrangement view of the print transfer system in first to fifth embodiments of the ink sheet transfer control apparatus of the present invention.
Figure 12:
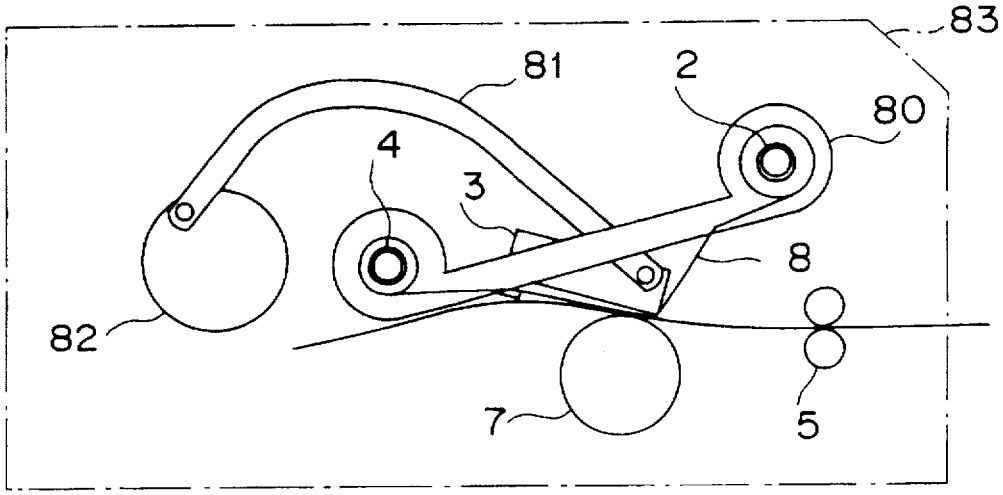
FIG. 12 is an arrangement view of the print system of a video printer.

FIG. 1 schematically shows the arrangement of the ink sheet transfer control apparatus common to the first to fifth embodiments of the ink sheet transfer control apparatus of the present invention. FIG. 12 shows the arrangement of the printing system of a video printer having the ink sheet transfer control apparatus. This video printer is able to put a thermal head 3 into or out of press contact with a platen 7 with the aid of an arm 81 by rotating a roller 82 for pressing or releasing a head. An ink sheet 8 is contained in and protected by an ink cassette 80, and the ink cassette 80 can be fitted to and removed from a printer 83.

As shown in FIG. 1, the ink sheet transfer control apparatus comprises an ink motor 1 and a grid motor 6. The ink motor 1 and the grid motor 6 are each provided by a DC (Direct Current) motor. The ink motor 1 and the grid motor 6 are controlled by a CPU (Central Processing Unit) 20.

The ink sheet 8 and recording paper 9 are inserted between the thermal head 3 and the platen 7. The ink sheet 8 is wound up around a winding roll 2 which driven by the ink motor 1. The recording paper 9 is transferred in the printing direction by a grid roller 5 rotated by the grid motor 6.

For the printing operation, first, with the thermal head 3 separated from the platen 7, the recording paper 9 is transferred up to the printing position by the grid roller 5, whereby a paper feed process is done. Next, with the thermal head 3 pressed against the platen 7, the recording paper 9 is transferred at a constant speed in the printing direction by the grid roller 5. At the same time, the ink sheet 8 is wound up by the winding roll 2 in arrow A direction at the same speed as the recording paper 9 is. During this process, electrical energy based on recording information is applied to the thermal head 3, so that heating elements, which are resistors that the thermal head 3 has, generate heat by electrical-to-thermal energy conversion. Then, the thermal head 3 fuses or sublimes the ink on the ink sheet 8, whereby the ink is transferred onto the recording paper 9.

Figure 4:
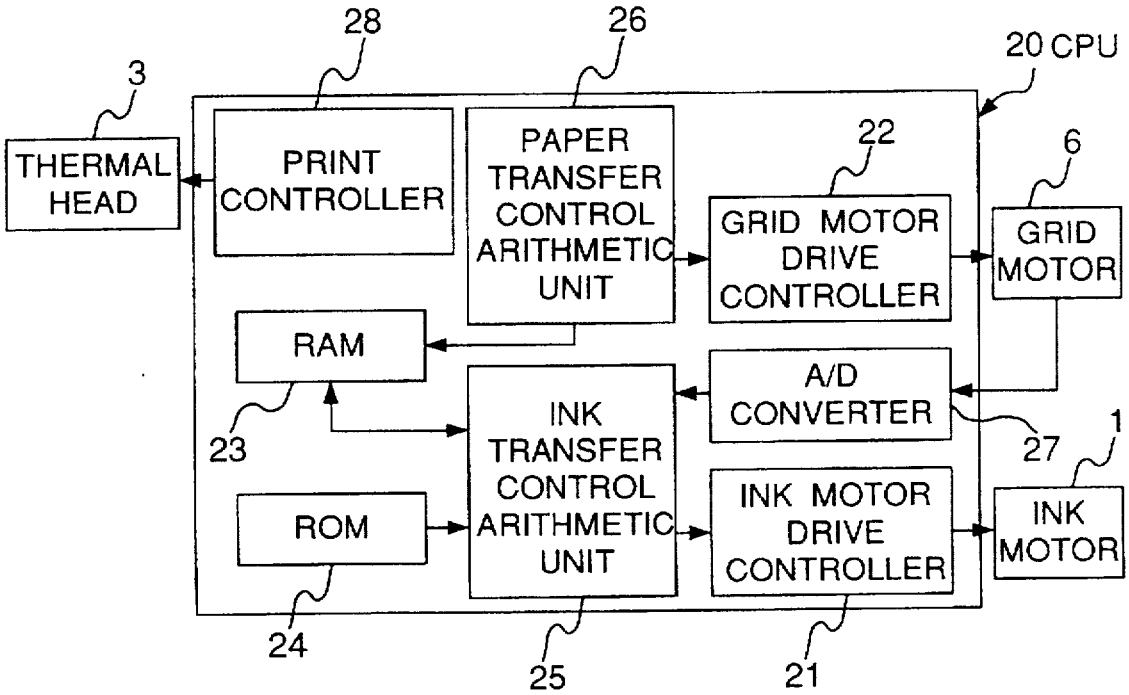
FIG. 4 is a block diagram functionally representing the CPU 20 shown in FIG. 1.

FIG. 4 shows the arrangement of the CPU 20 in terms of functions. As shown in FIG. 4, the CPU 20 comprises an ink motor drive controller 21 as well as a grid motor drive controller 22, an ink transfer control arithmetic unit 25, a paper transfer control arithmetic unit 26, a print controller 28, RAM (Random Access Memory) 23, ROM (Read Only Memory) 24, and an A/D (Analog-to-Digital) converter 27. The ROM 24 has previously stored transfer efficiency Ag, speed reduction ratio Bg, and torque constant KTg of the drive system for the recording paper 9, transfer efficiency Ai, speed reduction ratio Bi, and torque constant KTi of the drive system for the ink motor 1, counter-electromotive voltage constant KEi, coil resistance Rai, grid roller radius rg, paper transfer speed v, and current value Igr of the grid motor 6 corresponding to target transfer force Fgr of the recording paper 9.

The grid motor drive controller 22 performs control by driving the grid motor 6 in such a manner that the recording paper is transferred at a constant speed with the ink sheet and the recording paper sandwiched in press contact by the print head and the platen. That is, for the printing operation, while the recording paper 9 is transferred, feedback control is performed for controlling the drive voltage for the grid motor 6 according to external disturbances involved in load fluctuations due to printing.

FIRST EMBODIMENT

In this first embodiment, the drive voltage for the ink motor 1 is controlled according to the winding radius of the ink sheet 8 in a manner as described below, whereby the torque with which the ink motor 1 drives the winding roll 2 is controlled, so that the tension of the ink sheet 8 is maintained constant.

More specifically, in this first embodiment, during the process from the start of winding up the ink sheet 8 in arrow A direction until the heating of the thermal head 3 based on recording information, the CPU 20 operates in the step order of (a), (b), (c), (d), and (e).

Figure 5:
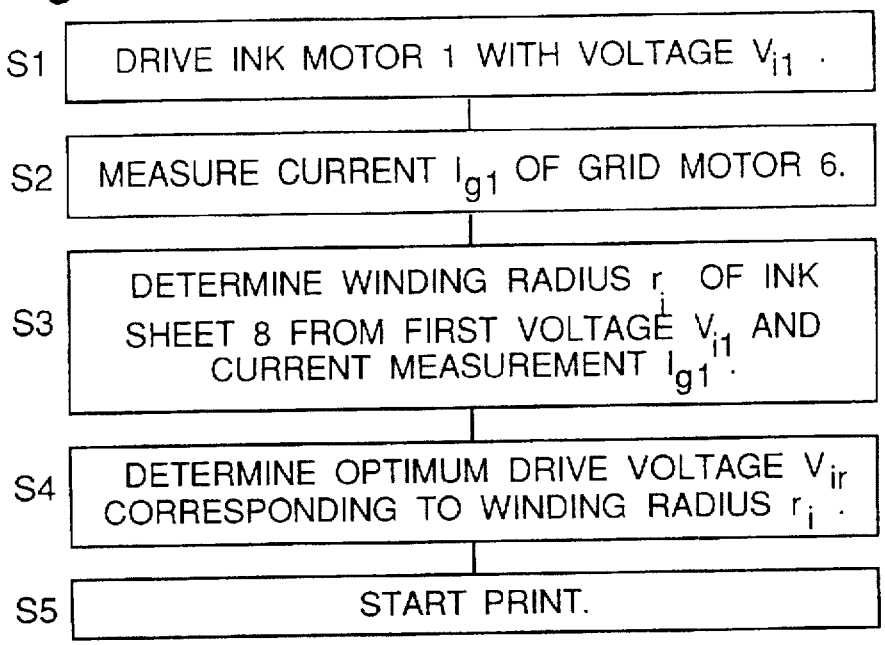
FIG. 5 is a flow chart for explaining the operation of the first embodiment of the present invention.

(a) First, as shown at step Si in FIG. 5, the ink transfer control arithmetic unit 25 controls the ink motor drive controller 21, and the ink motor drive controller 21 drives the ink motor 1 with a specified voltage Vi. Then, the RAM 23 stores the voltage Vi. At the same time, the paper transfer control arithmetic unit 26 controls the grid motor drive controller 22, and the grid motor drive controller 22 drives the grid motor 6 so that the recording paper 9 is transferred at a constant speed of a paper transfer speed v. This step S1 constitutes a first control means.

(b) Next, as shown at step S2 in FIG. 5, the ink transfer control arithmetic unit 25 converts a current $Ig_1$ flowing through the grid motor 6 into a digital value by the A/D converter 27, and stores the digitized current measurement $Ig_1$ into the RAM 23. This step S2 constitutes a measuring means.

(c) Next, as shown at step S3 in FIG. 5, the ink transfer control arithmetic unit 25 reads out of the RAM 23 the drive voltage Vi for the ink motor 1, which has been stored in the RAM 23 at step S1, and the current $Ig_1$ flowing through the grid motor 6, which has been stored in the RAM 23 at step S2.

Further, the ink transfer control arithmetic unit 25 reads out of the ROM 24 the transfer efficiency Ag of the drive system for the recording paper 9, the speed reduction ratio Bg of the recording paper drive system, the torque constant KTg of the recording paper drive system, the transfer efficiency Ai of the drive system for the ink motor 1, the speed reduction ratio Bi of the ink motor drive system, the torque constant KTi of the ink motor drive system, the counter-electromotive voltage constant KEi of the ink motor drive system, the coil resistance Rai, and the grid roller radius rg, and the paper transfer speed v.

The values of those transfer efficiencies Ag and Ai, speed reduction ratios Bg and Bi, torque constant KTg and KTi, counter-electromotive voltage constants KEi, coil resistance Rai, grid roller radius rg, and paper transfer speed v have previously been stored in the ROM 24.

Then, the ink transfer control arithmetic unit 25 calculates the winding radius ri of the ink sheet 8 as a parameter, from the drive voltage $Vi_1$ of the ink motor 1 set at the step S1, the current $Ig_1$ flowing through the grid motor 6 measured at the step S2, the above values Ag and Bg, KTg, Ai, Bi, KTi, KEi, Rai, and rg, and an equation of balance of force acting on the ink sheet 8 and the recording paper 9, where the equation includes the winding radius ri. As a result, the equation of balance is established. This step S3 constitutes a relational equation deciding means.

(d) Next, the ink transfer control arithmetic unit 25, as shown at step S4 in FIG. 5, the current value Igr of the grid motor 6 corresponding to the target transfer force Fgr of the recording paper 9 is substituted in the established equation of balance, so that an optimum drive voltage Vir of the ink motor 1 is calculated. Then, the ink transfer control arithmetic unit 25 controls the ink motor drive controller 21, so that the ink motor drive controller 21 drives the ink motor 1 with the calculated optimum drive voltage Vir. This step S4 constitutes a second control means.

(e) Next, as shown at step S5 in FIG. 5, the print controller 28 transmits a print start signal to the thermal head 3 to start printing.

Next described is the contents of arithmetic at the step S3, in which the ink transfer control arithmetic unit 25 calculates the winding radius ri of the ink sheet 8, establishes the equation of balance, and calculates the optimum drive voltage Vir of the ink motor 1.

Figure 2:
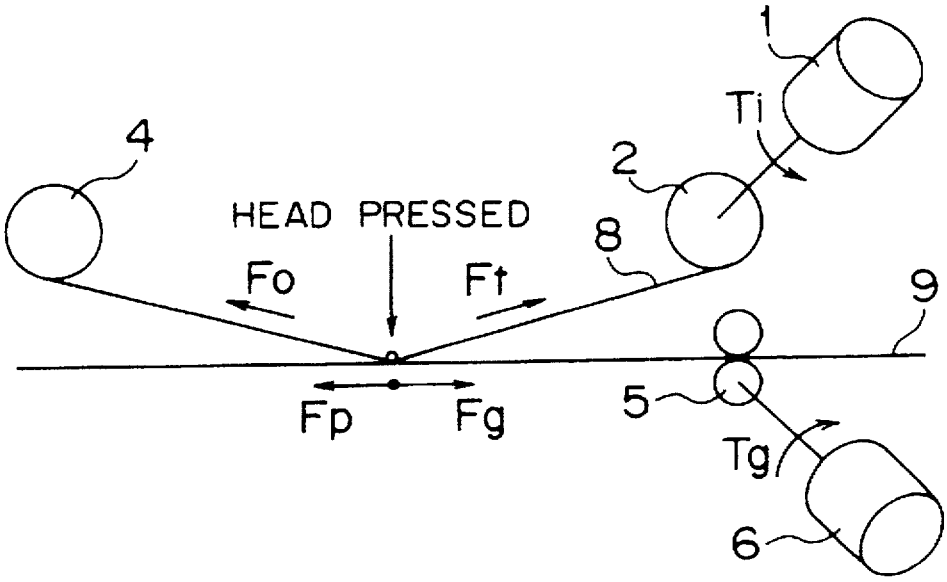
FIG. 2 is a view showing the relation of balance of forces of the print transfer system in a state that the ink sheet and the recording paper are being transferred in the printing direction.

In a state that the ink sheet 8 and the recording paper 9 are being integrally transferred in the printing direction as shown in FIG. 2, since the printing drive force Fp is the sum of the target transfer force Fg of the recording paper 9 and the transfer force Fi of the ink sheet 8, $$Fp=Fg+Fi \quad (1)$$

Also, since the transfer force Fi of the ink sheet 8 is a value resulting from subtracting a load component Fo applied only to the winding from the tension Ft of the ink sheet 8, $$Fi=Ft-Fo \quad (2)$$

Further, since the load component Fo applied only to the winding, although varying depending on the winding radius of the auxiliary glass frame 4, is small, $$Fo=\text{constant} \quad (3)$$

Furthermore, since the paper transfer control arithmetic unit 26 and the grid motor drive controller 22 control the grid motor 6 so that the transfer speed of the recording paper 9 becomes a constant v, $$Fp=\text{constant} \quad (4)$$

From the above equations (1) to (4), the following equations (5) to (7) hold:

$$Fp=Fg+Ft-Fo \quad (5)$$

$$F=Fp+Fo=Fg+Ft=\text{constant} \quad (6)$$

$$Ft=-Fg+F \quad (7)$$

In this connection, the tension Ft of the ink sheet 8 can be expressed by the following equation (8) with the use of the torque Ti generated by the ink motor 1, the transfer efficiency Ai of the drive system for the ink sheet 8, the speed reduction ratio Bi of the drive system for the ink sheet 8, and the winding radius ri:

$$Ft=Ti\times Ai\times Bi/ri \quad (8)$$

Also, the target transfer force Fg of the recording paper 9 can be expressed by the following equation (9) with the use of the torque Tg generated by the grid motor 6, the transfer efficiency Ag of the drive system for the recording paper 9, the speed reduction ratio $B_g$ of the drive system for the recording paper 9, and the grid roller radius rg:

$$Fg=Tg\times Ag\times Bg/rg \quad (9)$$

Substituting the above equations (8) and (9) in the equation (7) yields the following equation (10):

$$Ti\times Ai\times Bi/ri=-Tg\times Ag\times Bg/rg+F \quad (10)$$

Then, the following equation (11) can be deduced from the equation (10):

$$Ti=a_1\times Tg+b_1 \quad (11)$$

In this equation (11), the factors $a_1$ and $b_1$ can be expressed by the following equations (12) and (13):

$$a_1=-(Ag\times Bg/rg)/(Ai\times Bi/ri) \quad (12)$$

$$b_1=F/(Ai\times Bi/ri) \quad (13)$$

Generally, the relation between torque T and current value I of the DC motor can be expressed by the following equation (14) with the use of the torque constant KT:

$$T=KT\times I \quad (14)$$

Therefore, if the value of a current flowing through the ink motor 1 is Ii, the value of a current flowing through the grid motor 6 is Ig, the torque constant of the ink motor 1 is KTi, and if the torque constant of the grid motor 6 is KTg, then the above equation (11) can be rewritten into the following equation (15):

$$KTi\times Ii=a_1\times KTg\times Ig+b_1 \quad (15)$$

Further, the equation (15) can be rewritten into the following equation (16):

$$Ii=a_2\times Ig+b_2 \quad (16)$$

In this equation (16), the factors $a_2$ and $b_2$ can be expressed by the following equations (17) and (18):

$$a_2=a_1\times KTg/KTi \quad (17)$$

$$b_2=b_1/KTi \quad (18)$$

Then these equations (17) and (18) can be rewritten into the following equations (19) and (20):

$$a_2=\{-(Ag\times Bg/rg)/(Ai\times Bi/ri)\}\times KTg/KTi \quad (19)$$

$$b_2=\{F/(Ai\times Bi/ri)\}/KTi \quad (20)$$

The equation of motor characteristics can be expressed by the following equation (21) with the use of voltage V, counter-electromotive voltage constant KE, motor's number of revolutions N, and motor's coil resistance Ra:

$$V=KE\times N+I\times Ra \quad (21)$$

Therefore, rewriting the left side of the equation (16) by using a counter-electromotive constant KEi of the ink motor 1, an ink motor's number of revolutions Ni, and a coil resistance Rai yields the following equation (22):

$$(Vi-KEi\times Ni)/Rai=a_2\times I_g+b_2 \quad (22)$$

Then, this equation (22) can be rewritten into the following equation (23):

$$Vi=a_3\times Ig+b_3 \quad (23)$$

In this equation (23), the factors $a_3$ and $b_3$ are expressed by the following equations (24) and (25):

$$a_3=a_2\times Rai \quad (24)$$

$$b_3=b_2\times Rai+KEi\times Ni \quad (25)$$

These equations (24) and (25) can be rewritten into the following equations (26) and (27):

$$a_3=\{-(Ag\times Bg/rg)/(Ai\times Bi/ri)\}\times KTg\times Rai/KTi \quad (26)$$

$$b_3=\{F/(Ai\times Bi/ri)\}/KTi\times Rai+KEi\times Ni \quad (27)$$

where if the paper transfer speed is v (mm/s), the number of revolutions Ni. (rpm) of the ink motor 1 is $$Ni=v\times 60\times Bi/(2\times\pi\times ri) \quad (28)$$

Therefore, substituting the Ni expressed by the equation (28) into equation (27) yields the following equation (29):

$$b_3=\{F/(Ai\times Bi/ri)\}/KTi\times Rai+KEi+v\times 60\times Bi/(2\times\pi\times ri) \quad (29)$$

Then, since the transfer efficiency Ag, speed reduction ratio Bg, and the torque constant KTg of the drive system of the recording paper 9, the transfer efficiency Ai, speed reduction ratio Bi, torque constant KTi of the drive system of the ink motor 1, the counter-electromotive constant KEi, the coil resistance Rai, the grid roller radius rg, and the paper transfer speed v are all known constants, the above equations (26) and (29) can be rewritten into the following equations (30) and (31):

$$a_3=P_1\times ri \ (P_1 \text{ is a constant}) \quad (30)$$

$$b_3=P_2\times ri+P_3/ri \ (P_2 \text{ and } P_3 \text{ are constants}) \quad (31)$$

As can be seen from these equations (30) and (31), the two constants $a_3$ and $b_3$ of the equation (23) are expressed by one unknown value ri. Then, substituting the voltage $Vi_1$ of the ink motor 1 and the current measurement $Ig_1$ of the grid motor 6 into the equation (23) yields the following equation (32):

$$Vi_1=Ig_1\times P_1/ri+P_2\times ri+P_3 \quad (32)$$

The equation (32) can be rewritten into the following equation (33):

$$ri^2+P_4\times ri+P_5=0 \ (P_4 \text{ and } P_5 \text{ are constants}) \quad (33).$$

Accordingly, the winding radius ri of the winding roll 2 can be calculated by solving this quadratic equation (33).

Substituting the calculated winding radius ri into the equations (30) and (31) allows the constant $a_3$ and the constant $b_3$ to be calculated.

Calculating the constant $a_3$ and constant $b_3$ makes it possible to establish a relational expression between the current value Ig flowing through the grid motor 6 and the drive voltage Vi of the ink motor 1 which expression satisfies the equation (23), or the condition that the recording paper 9 and the ink sheet 8 are transferred integrally at a constant speed.

Then, the optimum drive voltage Vir of the ink motor 1 can be calculated by substituting the current value Igr of the grid motor 6 corresponding to the target transfer force Fgr of the recording paper 9 into the relational expression between the established grid motor current value Ig and ink motor drive voltage Vi.

Thus, according to the present first embodiment, the optimum drive voltage Vir for the ink motor 1 can be calculated by: (1) measuring the current value $Ig_1$ flowing through the grid motor 6 when the ink motor 1 is driven with a voltage $Vi_1$ prior to printing; (2) establishing an unknown parameter ri of a relational expression between the current value Ig flowing through the grid motor 6 and the drive voltage Vi which unknown parameter ri contains the winding radius ri of the ink sheet 8 as the unknown parameter and satisfies the condition that the recording paper 9 and the ink sheet 8 are transferred integrally at a constant speed; and (3) substituting the current value Igr of the grid motor 6 corresponding to the target transfer force Fgr of the recording paper 9 into the established relational expression.

Therefore, according to the first embodiment, the winding radius of the ink sheet 8 can be calculated and moreover the relational expression between the current value Ig flowing through the grid motor 6 and the drive voltage Vi of the ink motor 1 can be determined, by a simple mechanism without providing a pulse generator synchronized with the drive system of the winding roll. As a result, the grid motor 6 can be driven with the target transfer force Fgr at all times by varying the drive voltage Vi of the ink motor 1 according to variation in the winding radius of the winding roll. Consequently, according to the first embodiment, the tension of the ink sheet 8 can be maintained generally constant without being affected by any variation in the winding radius of the winding roll, so that the ink sheet 8 and the recording paper 9 can be transferred stably at all times. Hence, this first embodiment makes it feasible to improve the print grade.

The current flowing through the grid motor 6 has been measured by the ink transfer control arithmetic unit 25 and the A/D converter 27 in the above first embodiment. However, an alternative of measuring the current flowing through the grid motor 6 may be that a value of the drive voltage of the grid motor 6 calculated by the paper transfer control arithmetic unit 26 is stored in the RAM 23 and the stored drive voltage value of the grid motor 6 is read by the ink transfer control arithmetic unit 25. In this case, there is no need of providing the A/D converter 27, so that the constitution is simplified.

SECOND EMBODIMENT

Next, a second embodiment of the ink sheet transfer control apparatus of the present invention is described. The second embodiment has the same arrangement as shown in FIG. 1 and differs from the first embodiment only in that the CPU 20 shown in FIG. 4 operates according to the flow chart shown in FIG. 6 instead of that shown in FIG. 5. Accordingly, this second embodiment is explained mainly according to the flow chart shown in FIG. 6.

In this second embodiment, the drive voltage of the ink motor 1 is controlled according to the degree of deterioration of the ink motor 1 in a way as described below, whereby the torque with which the ink motor 1 drives the winding roll 2 is controlled, so that the tension of the ink sheet 8 is maintained constant. This allows the ink sheet 8 and the recording paper 9 to be transferred stably at all times and, as a result, the print grade is improved.

That is, in this second embodiment, during a period from when the ink sheet 8 is wound in the direction of arrow A until the thermal head 3 generates heat according to recording information, the CPU 20 operates in the order of (1), (2), (3), (4), (5), and (6) below.

Figure 6:
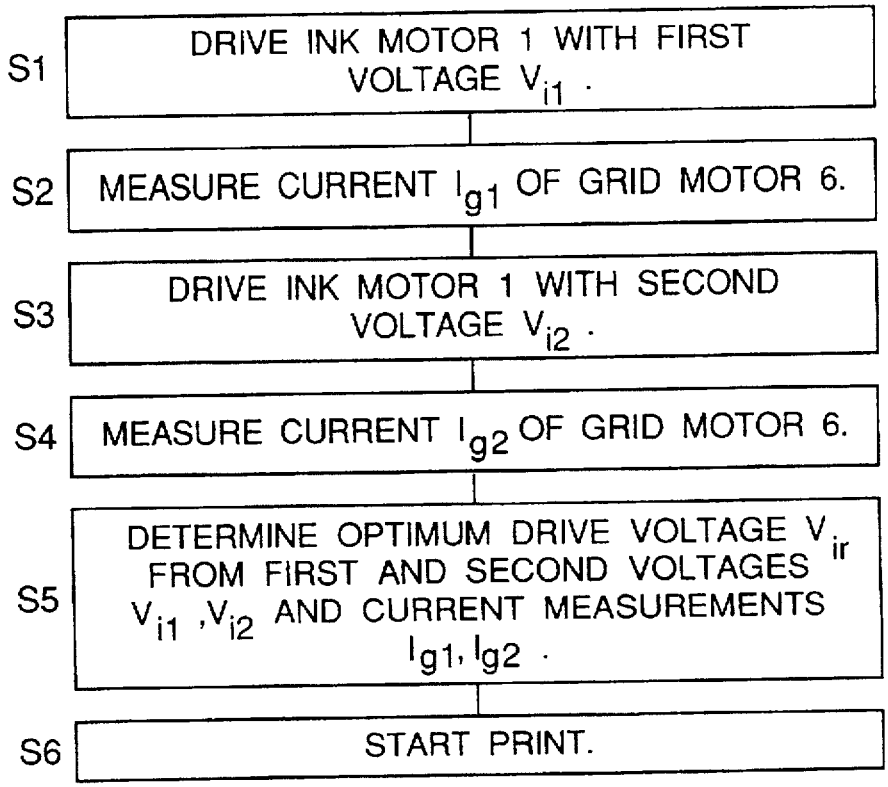
FIG. 6 is a flow chart for explaining the operation of the second embodiment of the present invention.

(1) First, as shown at step S1 in FIG. 6, the ink transfer control arithmetic unit 25 controls the ink motor drive controller 21, and the ink motor drive controller 21 in turn drives the ink motor 1 with a specified first ink motor drive voltage $Vi_1$. Then, the RAM 23 stores the first ink motor drive voltage $Vi_1$. At the same time, the paper transfer control arithmetic unit 26 controls the grid motor drive controller 22, and the grid motor drive controller 22 in turn drives the grid motor 6 so that the recording paper 9 is transferred at a constant speed of paper transfer speed v. This step S1 constitutes a first control means.

(2) Next, as shown at step S2 in FIG. 6, the ink transfer control arithmetic unit 25 converts the current $Ig_1$ flowing through the grid motor 6 into a digital value by the A/D converter 27, and stores the digitized current measurement $Ig_1$ in the RAM 23. This step S2 constitutes a first measuring means.

(3) Next, as shown at step S3 in FIG. 6, the ink transfer control arithmetic unit 25 controls the ink motor drive controller 21, and the ink motor drive controller 21 in turn drives the ink motor 1 with a specified second ink motor drive voltage $Vi_2$. Then, the RAM 23 stores the second ink motor drive voltage $Vi_2$. At the same time, the paper transfer control arithmetic unit 26 controls the grid motor drive controller 22, and the grid motor drive controller 22 in turn drives the grid motor 6 so that the recording paper 9 is transferred at a constant speed of paper transfer speed v.

(4) Next, as shown at step S4 in FIG. 6, the ink transfer control arithmetic unit 25 converts the current $Ig_2$ flowing through the grid motor 6 into a digital value by the A/D converter 27, and stores the digitized current measurement $Ig_2$ in the RAM 23. The above step S3 and step S4 constitute a second measuring means.

(5) Next, as shown at step S5 in FIG. 6, the ink transfer control arithmetic unit 25 reads out of the RAM 23 the first drive voltage $Vi_1$ of the ink motor 1 stored in the RAM 23 at step S1, the current $Ig_1$ flowing through the grid motor 6 stored in the RAM 23 at step S2, the second drive voltage $Vi_2$ of the ink motor 1 stored in the RAM 23 at step S3, and the current $Ig_2$ flowing through the grid motor 6 stored in the RAM 23 at step S4.

In other words, the ink transfer control arithmetic unit 25 reads from the RAM 23 in this step S5 two pairs of values ($Vi_1$, $Ig_1$) and ($Vi_2$, $Ig_2$) with which the ink sheet 8 and the recording paper 9 can be transferred integrally at a constant speed.

Then, the ink transfer control arithmetic unit 25 determines a relational expression between the ink sheet drive voltage Vi and the grid motor current Ig which relational expression satisfies the condition that the ink sheet 8 and the recording paper 9 can be transferred integrally at a constant speed, from the above two pairs of values ($Vi_1$, $Ig_1$) and ($Vi_2$, $Ig_2$).

Further, the ink transfer control arithmetic unit 25 reads out the current Igr of the grid motor 6 matching the target transfer force Fgr of the recording paper 9 that has previously been stored in the ROM 24, and substitutes the current Igr into the above determined relational expression to thereby calculate an optimum drive voltage Vir of the ink motor 1. The ink transfer control arithmetic unit 25 then controls the ink motor drive controller 21, and the ink motor drive controller 21 in turn drives the ink motor 1 with the calculated optimum drive voltage Vir. This step S5 constitutes a relational expression determining means and a second control means.

(6) Next, as shown at step S6 in FIG. 6, the print controller 28 sends a print start signal to the thermal head 3, whereby the print starts.

Below described is the contents of an operation in the foregoing step S5 by the ink transfer control arithmetic unit 25 for determining the aforementioned relational expression, or a conditional expression on which a specified tension can be developed to the ink sheet 8 so that the ink sheet and the recording paper can be transferred integrally at a constant speed, and further for calculating the optimum drive voltage Vir of the ink motor 1 from this conditional expression.

Figure 3:
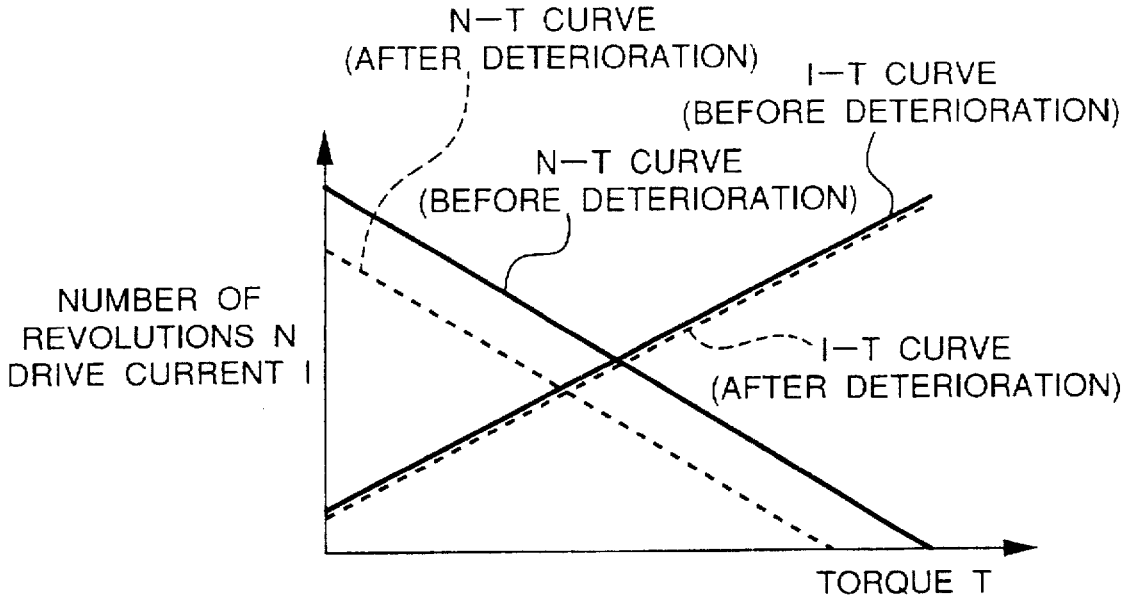
FIG. 3 is a characteristic view showing the relation between drive current and torque of the DC motor.

FIG. 3 charts the I-T curve (drive current torque curve) and N-T curve (number of revolutions—torque curve) of the DC motor. The solid line shows the I-T curve of the DC motor before deterioration, and the broken line shows the N-T curve of the DC motor after deterioration. As shown in FIG. 3, a motor deterioration will cause a change in the number of revolutions—torque curve, but almost no change in the drive current—torque curve. However, it is assumed here that deterioration of the DC motor is due most to deterioration of the brush, and negligibly less to deterioration of the bearing mechanism or the like.

Then when the deterioration of the DC motor is taken into account, the equation (21) of motor characteristics used in the first embodiment are formed into the following equation (34) with the deterioration coefficient D of the DC motor added:

$$V=(KE\times N+I\times Ra)/D \tag{34}$$

Then, the equation (34) is transformed into the following equation (35):

$$I=(V\times D-KE\times N)/Ra \tag{35}$$

Here assuming that the counter-electromotive constant KEi of the ink motor 1, the number of revolutions of the DC motor contained in the ink motor 1 is Ni, the coil resistance of the DC motor is Rai, and that the deterioration constant of the DC motor is Di, then an equation $Ii=(Vi\times Di-KEi\times Ni)/Rai$ yields. Substituting this equation into the equation of balance (16) derived in the first embodiment, i.e., $Ii=a_2\times Ig+b_2$ yields the following equation (36), where the equation (36) is an equation of balance in the second embodiment:

$$(Vi\times Di-KEi\times Ni)/Rai=a_2\times Ig+b_2 \tag{36}$$

Then the equation (36) leads to the following equation (37):

$$Vi=a_4\times Ig+b_4 \tag{37}$$

This equation (37) is a conditional expression on which the ink sheet 8 and the recording paper 9 can be transferred integrally at a constant speed in the second embodiment.

Incidentally, the constant $a_4$ and constant $b_4$ of this conditional expression contain the deterioration constant Di. It is therefore difficult to determine by calculation the deterioration constant Di.

Assuming here that the variation in the winding radius $r_1$ of the ink sheet 8 in one-time printing operation is small, and that the deterioration of the DC motor contained in the ink motor 1 and its number of revolutions are generally constant, then it can be said that the voltage Vi and the current Ig flowing through the grid motor 6 with which the ink motor 1 is driven during the one-time printing operation are in a proportional relation. That is, the equation (37) can be said to be an equation representing a proportional relation.

Thus, the voltage for driving the ink motor 1 is changed two times as $Vi_1$, $Vi_2$ as already described, and the then resulting currents $Ig_1$, $Ig_2$ flowing through the grid motor 6 are measured and substituted into the equation (37), whereby the following equations (38) and (39) are obtained:

$$Vi_1=a_4\times Ig_1+b_4 \tag{38}$$

$$Vi_2=a_4\times Ig_2+b_4 \tag{39}$$

Therefore, the constant $a_4$ and constant $b_4$ can be calculated from these equations (38) and (39), and the constant $a_4$ and $b_4$ can be expressed by the following equations (40) and (41), respectively:

$$a_4=(Vi_1-Vi_2)/Ig_1-Ig_2) \tag{40}$$

$$b_4=(Vi_2\times Ig_1-Vi_1\times Ig_2)/(Ig_1-Ig_2) \tag{41}$$

Then, substituting the constant $a_4$ shown by the equation (40) and the constant $b_4$ shown by the equation (41) into the equation (37) yields the following equation (42):

$$Vi=(Vi_1-Vi_2)/(Ig_1-Ig_2)\times Ig+(Vi_2\times Ig_1-Vi_1\times Ig_2)/(Ig_1-Ig_2) \tag{42}$$

This equation (42) can be rewritten into the following equation (43):

$$Vi=\{(Vi_1-Vi_2)\times Ig+Vi_2\times Ig_1-Vi_1\times Ig_2\}/(Ig_1-Ig_2) \tag{43}$$

Thus, the conditional expression (43) on which a specified tension can be developed to the ink sheet 8 so that the ink sheet 8 and the recording paper 9 can be transferred integrally at a constant speed has now been determined.

Accordingly, by substituting into the determined conditional expression (43) the current Igr flowing through the grid motor 6 when the target transfer force Fgr of the grid motor 6 is achieved, the optimum drive voltage Vir for driving the ink motor 1 can be calculated, and the optimum drive voltage Vir is expressed by the following equation:

$$Vir=\{(Vi_1-Vi_2)\times Igr+Vi_2\times Ig_1-Vi_1\times Ig_2\}/(Ig_1-Ig_2) \quad (44)$$

As seen above, according to the second embodiment, two recording paper drive currents $Ig_1$ and $Ig_2$ corresponding to specified different ink sheet drive voltages $Vi_1$ and $Vi_2$ are measured, whereby a relational expression of balance in which these $Vi_1$, $Ig_1$ and $Vi_2$, $Ig_2$ represent the deterioration constant Di of the ink motor 1. Therefore, according to the second embodiment, an optimum ink sheet drive voltage Vir matching the current Igr of the grid motor 6 for implementing a transfer force Fgr targeted by the grid motor 6 can be derived without requiring any complex structure like pulse generators. Accordingly, according to the second embodiment, the grid motor 6 can be transferred stably at all times so that the print grade can be improved.

THIRD EMBODIMENT

Next, a third embodiment of the present invention is described. The third embodiment is similar in the arrangement as shown in FIG. 1 to the first embodiment, and different from the first embodiment only in that the CPU 20 shown in FIG. 4 operates according to the flow chart shown in FIG. 7 instead of that shown in FIG. 5. Accordingly, this third embodiment is explained mainly according to the flow chart shown in FIG. 7.

In this third embodiment, the drive voltage of the ink motor 1 is controlled according to the degree of deterioration of the ink motor 1 as in the second embodiment. In addition to this, deterioration of the grid motor 6 is detected and the detected deterioration of the grid motor is also reflected on the control of the ink motor, in which arrangement this embodiment differs from the second embodiment. In other words, in this third embodiment, not only the deterioration of the ink motor 1 but also the deterioration of the grid motor 6 are detected.

In the third embodiment, during a period from when the ink sheet 8 is started being wound in the direction of arrow A until the thermal head 3 generates heat based on recording information, the CPU 20 operates in the order of (i), (ii), (iii), (iv), (v), (vi), and (vii) below.

Figure 7:
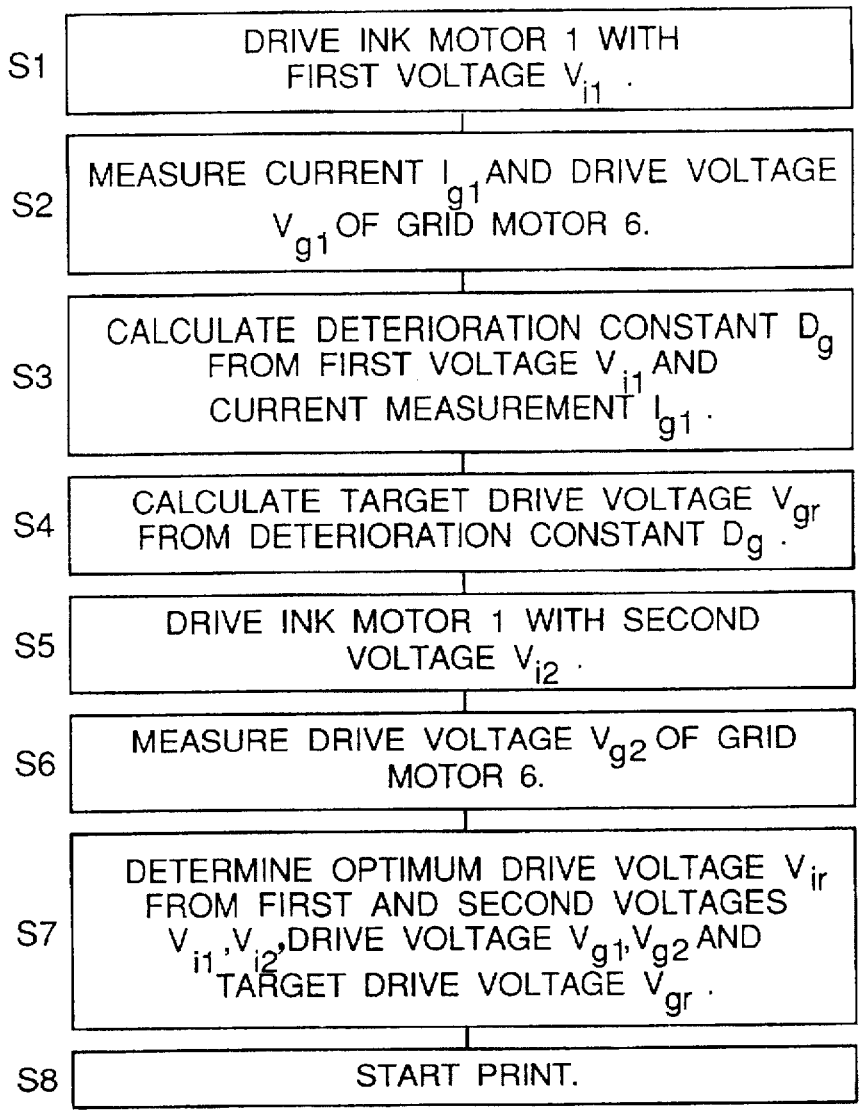
FIG. 7 is a flow chart for explaining the operation of the third embodiment of the present invention.

(i) First, as shown at step S1 in FIG. 7, the ink transfer control arithmetic unit 25 controls the ink motor drive controller 21, and the ink motor drive controller 21 in turn drives the ink motor 1 with a specified first ink motor drive voltage $Vi_1$. Then, the RAM 23 stores the first ink motor drive voltage $Vi_1$. At the same time, the paper transfer control arithmetic unit 26 controls the grid motor drive controller 22, and the grid motor drive controller 22 in turn drives the grid motor 6 so that the recording paper 9 is transferred at a constant speed of paper transfer speed v. This step S1 constitutes a first control means.

(ii) Next, as shown at step S2 in FIG. 7, the ink transfer control arithmetic unit 25 converts the current $Ig_1$ flowing through the grid motor 6 into a digital value by the A/D converter 27, and stores the digitized current measurement $Ig_1$ in the RAM 23. At the same time, the paper transfer control arithmetic unit 26 stores in the RAM 23 the drive voltage $Vg_1$ with which the grid motor drive controller 22 is driving the grid motor 6. The above step S1 and step S2 constitute a first measuring means.

(iii) Next, as shown at step S3 in FIG. 7, the ink transfer control arithmetic unit 25 reads out the drive voltage $Vg_1$ of the grid motor 6 and the current value $Ig_1$ of the grid motor 6 stored in the RAM 23, as well as the counter-electromotive constant KEg, number of revolutions Ng, and coil resistance Rag of the grid motor 6 stored in the ROM 24. Then, the ink transfer control arithmetic unit 25 calculates the deterioration constant Dg of the grid motor 6 from the foregoing drive voltage $Vg_1$ and current $Ig_1$, and characteristic values KEg, Ng, and Rag on the grid motor read from the ROM 24. The ink transfer control arithmetic unit 25 stores the calculated deterioration constant Dg in the RAM 23. This step S3 constitutes a deterioration constant calculating means.

(iv) Next, as shown at step S4 in FIG. 7, the ink transfer control arithmetic unit 25 reads the deterioration constant Dg of the grid motor 6 stored in the RAM 23, and calculates a target drive voltage Vgr of the grid motor 6 based on the read deterioration constant Dg. Then, the ink transfer control arithmetic unit 25 stores the calculated target drive voltage Vgr in the RAM 23. This step S4 constitutes a target recording paper drive voltage correcting means.

(v) Next, as shown at step S5 in FIG. 7, the ink transfer control arithmetic unit 25 controls the motor drive controller 21, whereby the ink motor 1 is driven with a specified second ink motor drive voltage $Vi_2$. Then, the RAM 23 stores the second ink motor drive voltage $Vi_2$. At the same time, the paper transfer control arithmetic unit 26 controls the grid motor drive controller 22 to drive the grid motor 6 so that the recording paper 9 is transferred at a constant speed of paper transfer speed v.

(vi) Next, as shown at step S6 in FIG. 7, the paper transfer control arithmetic unit 26 stores the drive voltage $Vg_2$ of the grid motor 6 in the RAM 23. The above step S5 and step S6 constitute a second measuring means.

(vii) Next, as shown at step S7 in FIG. 7, the ink transfer control arithmetic unit 25 reads out the first and second drive voltages $Vi_1$, $Vi_2$ of the ink motor 1 and the first and second drive voltages $Vg_1$, $Vg_2$ of the grid motor 6 stored in the RAM 23. Then, the ink transfer control arithmetic unit 25 determines a relational expression between the ink sheet drive voltage Vi and the grid motor drive voltage Vg which relational expression satisfies the condition that the ink sheet 8 and the recording paper 9 can be transferred integrally at a constant speed, from the above two pairs of values ($Vi_1$, $Vi_2$) and ($Vg_1$ and $Vg_2$).

Further, the ink transfer control arithmetic unit 25 reads out the target drive voltage Vgr of the grid motor 6 stored in the RAM 23.

The ink transfer control arithmetic unit 25 substitutes the resulting grid motor target drive voltage Vgr into the above determined relational expression to thereby calculate an optimum drive voltage Vir of the ink motor 1. Then, the ink motor 1 is driven by the ink motor drive controller 21 with the optimum drive voltage Vir. This step S7 constitutes a relational expression determining means and a second control means.

(viii) Next, as shown at step S8 in FIG. 7, the print controller 28 sends a print start signal to the thermal head 3, whereby the print starts.

The calculation formulas for the target drive voltage Vgr of the grid motor 6 and the optimum drive voltage Vir of the ink motor 1 are based on the following theory.

With the use of the equation (34) that is a characteristic expression of the DC motor used in the second embodiment, and assuming that the deterioration constant of the grid motor 6 is Dg, the counter-electromotive constant of the grid motor 6 is KEg, the motor's number of revolutions is Ng, and coil resistance is Rag, then the following equation (45) is obtained:

$$Ig=(Vg\times Dg-KEg\times Ng)/Rag \quad (45)$$

Substituting the Ig expressed by the equation (45) into the equation (37) used in the second embodiment yields the following equation (46):

$$Vi=a_4\times(Vg\times Dg-KEg\times Ng)/Rag+b_4 \quad (46)$$

With the use of a constant "$a_5$" and a constant "$b_5$", this equation (46) can be rewritten into the following equation (47):

$$Vi=a_5\times Vg+b_5 \text{ ($a_5$ and $b_5$ are constants)} \quad (47)$$

In other words, the voltage Vi of the ink motor 1 and the voltage Vg of the grid motor 6 are in a proportional relation in one-time printing operation. Accordingly, the voltage of the ink motor 1 is changed two times so as to be set to $Vi_1$ and $Vi_2$, the then resulting voltages $Vg_1$ and $Vg_2$ of the grid motor 6 are measured and substituted into the equation (46). As a result, the following equations (48) and (49) are obtained:

$$Vi_1=a_5\times Vg_1+b_5 \quad (48)$$

$$Vi_2=a_5\times Vg_2+b_5 \quad (49)$$

From these equations (48) and (49), the constants $a_5$ and $b_5$ can be determined, and the following equations (50) and (51) can be obtained:

$$a_5(Vi_1-Vi_2)/(Vg_1-Vg_2) \quad (50)$$

$$b_5=(vi_2\times Vg_1-Vi_1\times Vg_2)/(Vg_1-Vg_2) \quad (51)$$

Therefore, substituting the constant $a_5$ and the constant $b_5$ expressed by the above equations (50) and (51) into the equation (47) yields the following equation (52):

$$Vi=(Vi_1-Vi_2)/(Vg_1-Vg_2)\times(Vg+(Vi_2\times Vg_1-Vi_1\times Vg_2)/(Vg_1-Vg_2) \quad (52)$$

From this equation (52), the following equation (53) can be obtained:

$$Vi=\{(Vi_1-Vi_2)\times Vg+Vi_2\times Vg_1-Vi_1\times Vg_2\}/(Vg_1-Vg_2) \quad (53)$$

Now the deterioration constant Dg can be calculated by the following equation (54) from the measured drive current $Ig_1$ and drive voltage $Vg_1$, of the grid motor 6:

$$Dg=(KEg\times Ng+Ig_1\times Rag)/vg_1 \quad (54)$$

Then, from this deterioration constant Dg and the current Igr of the grid motor 6 matching the target transfer force Fgr of the recording paper 9, the target drive voltage Vgr of the grid motor 6 can be calculated by the following equation (55):

$$Vgr=(KEg\times Ng+Igr\times Rag)/Dg \quad (55)$$

If this Vgr is substituted into the equation (53), the then resulting optimum drive voltage Vir of the ink motor 1 can be expressed by the following equation (56):

$$Vir=\{(Vi_1-Vi_2)\times Vgr+Vi_2\times Vg_1-Vi_1\times Vg_2\}/(Vg_1-Vg_2) \quad (56)$$

As seen above, according to the third embodiment, such a relational expression between the ink motor drive voltage and the grid motor drive voltage that the ink sheet 8 and the recording paper 9 are transferred integrally at a constant speed can be determined from the two pairs of values ($Vi_1$, $Vg_1$) and ($Vi_2$, $Vg_2$) of the ink motor drive voltage and the grid motor drive voltage. Moreover, the deterioration constant Dg of the grid motor is calculated from the grid motor drive voltage $Vg_1$ and drive current $Ig_1$ and, by using the resulting deterioration constant Dg, a target drive voltage Vgr of the grid motor 6 corrected by the deterioration constant Dg is calculated. Then, by substituting into the above relational expression the target drive voltage Vgr of the grid motor 6, in which the deterioration constant Dg of the grid motor 6 has been taken into account, the optimum drive voltage Vir of the ink motor 1 is calculated.

Consequently, according to the third embodiment, the optimum drive voltage Vir of the ink motor 1 is calculated correspondingly to not only the deterioration of the ink motor 1 but also the deterioration of the grid motor. As a result, the ink sheet can be transferred stably at all times so that the print grade can be improved.

In addition, in the third embodiment, the target drive voltage Vgr of the grid motor 6, Vgr=(KEg×Ng+Igr×Rag)/Dg(55), is reflected on the expression for calculating the target drive voltage Vgr by using the deterioration constant Dg of the grid motor as it is. This means that the ink motor 1 is burdened all alone with the load effect due to the deterioration of the grid motor 6. Alternatively, the target drive voltage Vgr of the grid motor 6 may also be determined by the following equation (57):

$$Vgr=(KEg\times Ng+Igr\times Rag)\times G/Dg \quad (57)$$

In this case, the load burden due to the deterioration of the grid motor 6 can be shared by the grid motor 6 and the ink motor 1.

Also, such an arrangement is possible that when the deterioration constant Dg of the grid motor determined by the equation (54) becomes below a predetermined deterioration constant Dm showing the use limit of the grid motor 6, it is displayed to the user or it is made known to the user by speech or the like. In this case, the ink motor 1 can be prevented from any overload.

In the third embodiment, the drive voltages $Vg_1$ and $Vg_2$ stored in the RAM 23 have been read into the ink transfer control arithmetic unit 25. Otherwise, the drive voltage of the grid motor 6 may be measured directly from the grid motor.

FOURTH EMBODIMENT

Next, a fourth embodiment of the ink sheet transfer control apparatus of the present invention is described.

Figure 8:
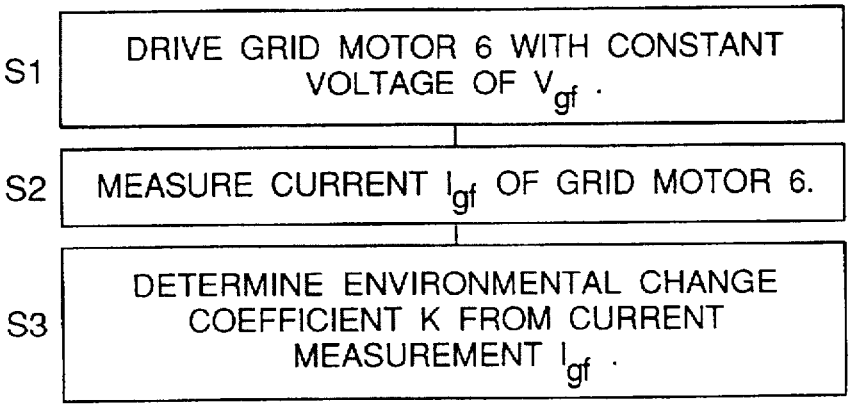
FIG. 8 is a flow chart for explaining the operation of the fourth embodiment of the present invention.

The fourth embodiment provides an ink sheet transfer control apparatus as described in any one of the first, second, and third embodiments, wherein the CPU 20 performs the following operations (1), (2), and (3) with the thermal head 3 separated from the platen 7 during the paper transfer process in which the recording paper 9 is being transferred to the printing position by the grid roller 5, before the operations as described in the first, second, or third embodiment:

(1) First, as shown at step S1 in FIG. 8, the paper transfer control arithmetic unit 26 shown in FIG. 4 controls the grid motor drive controller 22, whereby the grid motor 6 is driven with a constant voltage of arbitrarily determined voltage $Vg_1$.

(2) Next, as shown at step S2 in FIG. 8, the ink transfer control arithmetic unit 25 measures the current $Ig_1$ derived from the grid motor 6 as a digital value via the A/D converter 27. Then, the ink transfer control arithmetic unit 25 stores the current measurement $Ig_1$ in the RAM 23. The above step S1 and step S2 constitute a current measuring means.

(3) Next, as shown at step S3 in FIG. 8, the ink transfer control arithmetic unit 25 reads out the current measurement $Ig_1$ of the grid motor 6 stored in the RAM 23 and determines an environmental change coefficient K.

The calculation of the environmental change coefficient K is based on the following theory.

When paper is fed under certain conditions (e.g., temperature: 25° C., humidity: 50%, etc) with the thermal head 3 separated from the platen 7, all the factors but those of the recording paper drive system are excluded in this paper transfer operation.

Accordingly, in this case, as far as the factors of the recording paper drive system remain unchanged, the target transfer force of the recording paper 9 is constant and therefore the torque required for the grid motor 6 is also constant. Then, in this case, as described before, the drive current—torque curve is not affected almost at all by deterioration of the DC motor. Therefore, if the torque required for the grid motor is constant, the drive current of the grid motor 6 is also constant.

However, if the factors of the recording paper drive system has changed by the effect of some change in the factors of the transfer system of the recording paper drive system due to some environmental change, or by wear of the transfer system or the like, then the target transfer force of the recording paper 9 changes. As a result, the drive current of the grid motor 6 also changes.

Therefore, by previously determining through measurement or calculation the current value $Ig_0$ of the grid motor 6 that results when the grid motor 6 is driven with a constant voltage of specified voltage $Vg_1$ under specified environments, the environmental change coefficient K representing the driving ability of the recording paper drive system (except the grid motor) due to the environmental change can be calculated by the following equation (58):

$$K=Ig_1/Ig_0 \quad (58)$$

Therefore, by integrating this environmental change coefficient K into a calculating formula for calculating the target transfer force Fgr of the grid motor used in any one of the first, second, or third embodiment, the driving force of the ink motor 1 can be controlled so that the driving ability of the recording paper drive system due to an environmental change is compensated.

Accordingly, when this fourth embodiment is combined with the first embodiment, not only the drive voltage Vi of the ink motor 1 can be controlled so that a change in the winding radius of the winding roll 2 of the ink motor 1 is compensated, but also the drive voltage Vi of the ink motor 1 can be controlled so that the change in the ability of the recording paper drive system except the grid motor 6 due to an environmental change (or the environmental change coefficient K) is compensated. Consequently, in combination of the fourth embodiment and the first embodiment, when the winding radius of the winding roll 2 and the environmental change coefficient K have changed the transfer force of the ink motor 1 and the recording paper 9, this change can be detected immediately and the change can be compensated by the driving force of the ink motor 1. Thus, the ink motor 1 and the recording paper 9 can be transferred stably at all times at a constant speed.

Also, in combination of the fourth embodiment with the second embodiment, when a deterioration of the ink motor 1 and the environmental change coefficient K have changed the transfer force of the ink motor 1 and the recording paper 9, this change is detected immediately and the change can be compensated by the driving force of the ink motor 1.

Further, in combination of the fourth embodiment with the third embodiment, when a deterioration of the ink motor 1, a deterioration of the grid motor 6, and a change in the ability of the recording paper drive system (except the grid motor) have changed the transfer force of the ink motor 1 and the recording paper 9, the change can be detected immediately and the change can be compensated by the driving force of the ink motor 1.

In the above fourth embodiment, the environmental change coefficient K determined with the thermal head 3 separated from the platen 7 has been integrated, as it is, into the calculation formula for calculating the target transfer force Fgr of the grid motor. However, in actual cases, the platen 7 and the thermal head 3 are pressed against each other with the ink sheet 8 and the recording paper 9 sandwiched therebetween. So, with this fact taken into account, a coefficient calculated separately from the environmental change coefficient K may be operated on the environmental change coefficient K in addition, subtraction, multiplication, or division.

Also, in the fourth embodiment, paper feed has been performed with the thermal head 3 separated from the platen 7. However, it is also possible to feed paper with the thermal head 3 pressed against the platen 7 and without driving the ink motor 1. In this case, there arises a need of eliminating the loosening of the ink sheet 8. Fortunately, since an environmental change coefficient in a state close to the transfer state during printing can be determined, the ink sheet 8 can be controlled with high accuracy.

FIFTH EMBODIMENT

Next, a fifth embodiment of the ink sheet transfer control apparatus according to the present invention is described. The fifth embodiment is a modification of the second embodiment. Because the fifth embodiment differs from the second embodiment only in the operation of the CPU 20, the operation of the CPU 20 is mainly explained.

Figure 9:
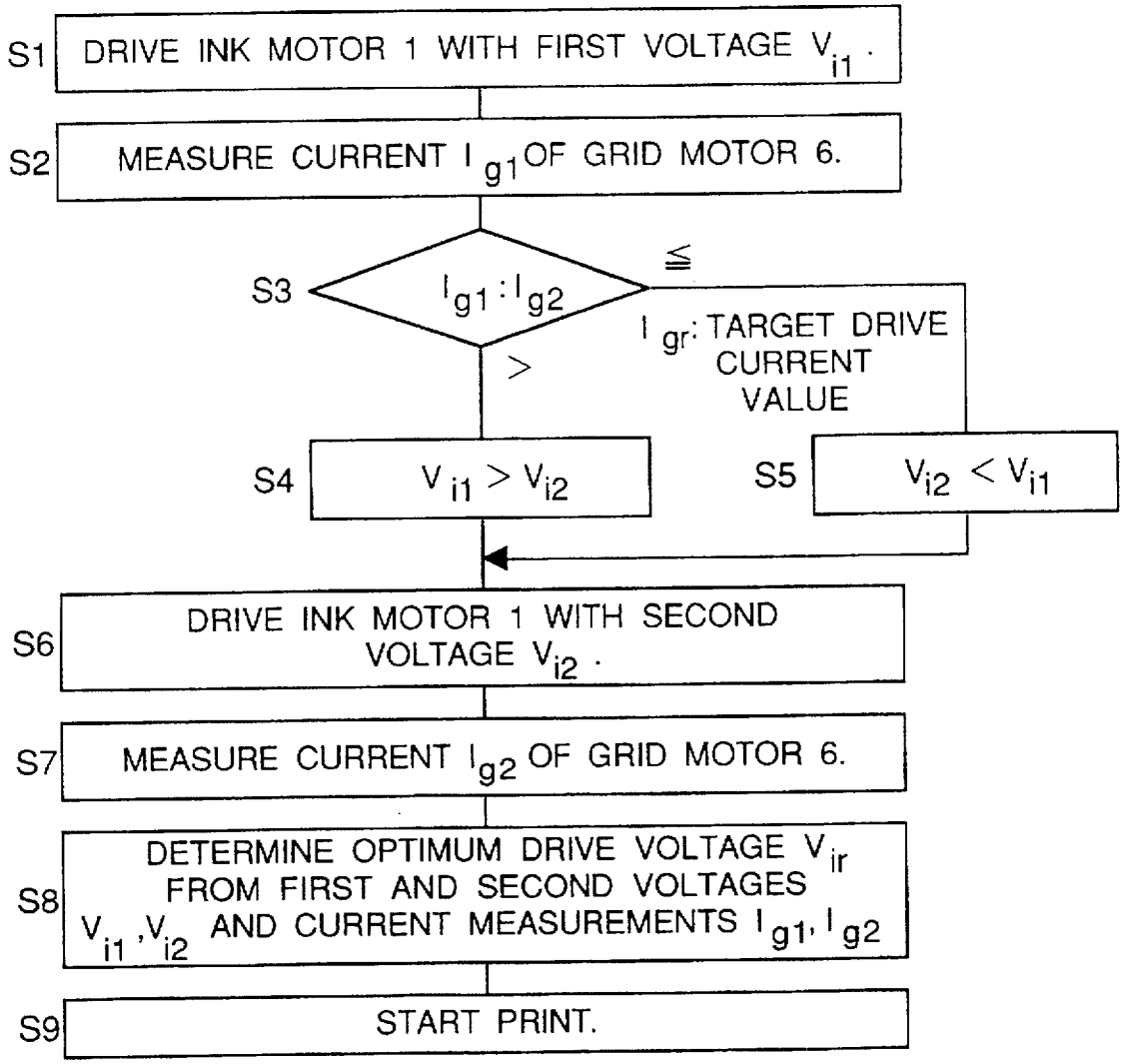
FIG. 9 is a flow chart for explaining the operation of the fifth embodiment of the present invention.
Figure 10:
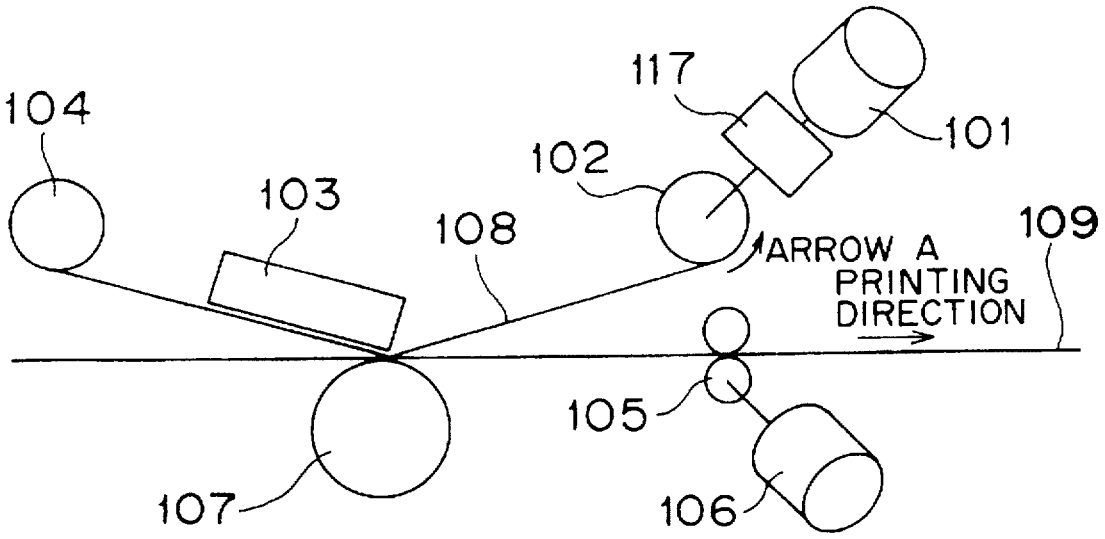
Fig. 10 PRIOR ART
FIG. 10 is an arrangement view of the print transfer system of the conventional ink sheet transfer control apparatus.

In the fifth embodiment, the CPU 20 operates according to a flow chart in which the step S3, step S4, and step S5 in FIG. 9 are added between the step S2 and the step S3 in FIG. 6 of the second embodiment. The operations of step S3 through step S5 in FIG. 5 are described in the order of (A), (B), and (C) below. These step S3 through step S5 constitute a measurement control means.

(A) First, as shown at step S3 in FIG. 9, the ink transfer control arithmetic unit 25 reads out the current measurement $Ig_1$ of the grid motor 6 stored in the RAM 23 while it reads out the current Igr of the grid motor 6 corresponding to the target transfer force of the recording paper 9 stored in the ROM 24. Then, the ink transfer control arithmetic unit 25 compares the current measurement $Ig_1$ and the target current value Igr of the grid motor with each other. Subsequently, if $Ig_1>Igr$, then the following operation (B) is done; and if $Ig_1 \leqq Igr$, then the following operation (C) is done.

(B) As shown at step S4 in FIG. 9, the ink transfer control arithmetic unit 25 determines the second voltage $Vi_2$ so that $Vi_2>Vi_1$.

(C) As shown at step S5 in FIG. 9, the ink transfer control arithmetic unit 25 determines the second voltage $Vi_2$ so that $Vi_2<Vi_1$.

As seen above, in the fifth embodiment, if the first recording paper drive current $Ig_1$ is greater than the target recording paper drive current Igr, then the second ink sheet drive voltage $Vi_2$ is set larger than the first ink sheet drive voltage $Vi_1$. Meanwhile, if the second recording paper drive current $Ig_2$ is smaller than the target recording paper drive current Igr, then the second ink sheet drive voltage $Vi_2$ is set smaller than the first ink sheet drive voltage $Vi_1$.

Therefore, according to the fifth embodiment, a result of measuring the first recording paper drive current $Ig_1$ can be utilized for setting the second ink sheet drive voltage $Vi_1$. That is, according to the fifth embodiment, the second ink sheet drive voltage $Vi_2$ can be made closer to the optimum ink sheet drive voltage Vir than the first ink sheet drive voltage $Vi_1$ can. As a result, according to the fifth embodiment, even until the optimum ink motor driving force is calculated, the ink sheet can be transferred as stably as possible.

It is noted that, in this fifth embodiment, if $Ig_1=Ig_2$, then either the operation of (B) or (C) may be performed. Also, if $Ig_1=Igr$, then $Vir=Vi_1$, where the operations of step S7 and followers in FIG. 9 may be halted.

Further, in this fifth embodiment, it has been arranged that the CPU 20 operates according to the flow chart in which the steps S3, S4, and S5 in FIG. 9 are added between the steps S2 and S3 in FIG. 6. Otherwise, the CPU 20 may be arranged so as to operate according to a flow chart in which the steps S3, S4, and S5 in FIG. 9 are added between the steps S4 and S5 in FIG. 7. In this case, also, a result of measuring the first recording paper drive current $Ig_1$ can be utilized for setting the second ink sheet drive voltage $Vi_2$. That is, the second ink sheet drive voltage $Vi_2$ can be made closer to the optimum ink sheet drive voltage Vir than the first ink sheet drive voltage $Vi_1$ can.

In addition, in the first to fifth embodiments, the recording paper drive system is equipped with the grid roller 5. However, it is also possible that the recording paper drive system is not equipped with a grid roller but that the recording paper is transferred by being wound around a platen drum. Further, whereas the thermal head 3 has been provided in the embodiments, a conducting head may be provided in place of the thermal head. Furthermore, the present invention is applicable to any printing device only if the printing operation is carried out with the ink sheet and the recording paper pressed against each other.

Also, in the above-described first to fifth embodiments, the ink motor 1 and the grid motor 6 are of such indirect drive that the driving force of the ink motor 1 and the grid motor 6 is transferred to the ink sheet 8 and the recording paper 9 via a transfer system device. However, they may also be of such direct drive that either one of the ink motor 1 or the recording paper 9 is driven directly by a motor. In such a case, there is eliminated the need of taking into account the transfer efficiency A and the speed reduction ratio B with respect to the drive system that performs direct drive. Therefore, the optimum drive voltage Vir for the ink motor 1 can be calculated more easily, advantageously.

Further, such an arrangement as described below is also possible. That is, an optimum drive voltage Vir for the ink motor 1 is determined through calculation or measurement in correspondence to each combination of the voltages Vi, Vg and currents Ii, Ig for the ink motor 1 and the grid motor 6. Optimum drive voltages Vir for the ink motor 1 corresponding to the individual combinations of the voltages Vi, Vg and currents Ii, Ig are previously stored in the ROM 24 as a look-up table (LUT). Then, the ink transfer control arithmetic unit 25 reads out an optimum drive voltage Vir matching each combination of the drive voltage and the current measurements of the ink motor 1 and the grid motor 6, so that the ink sheet is controlled for its transfer.

Figure 11:
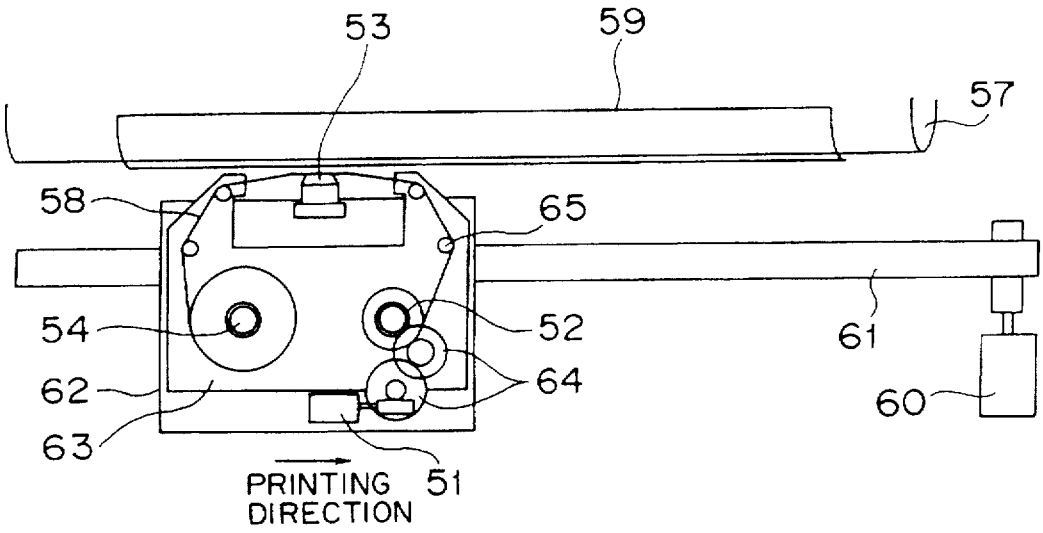
FIG. 11 is an arrangement view of the print system of a serial printer to which the present invention is applicable.

Furthermore, whereas the present invention has been applied to a line printer in the above first to fifth embodiments, the present invention may also be applied to serial printers other than line printers. The configuration of the printing system in this case is shown in FIG. 11. In a serial printer, an ink sheet cassette 63 is loaded on a carriage 62. Then, by driving a carriage motor 60, the ink sheet cassette 63 can be reciprocatingly transferred in the printing direction through a transfer roller 61. An ink sheet 58 is loaded on the ink sheet cassette 63 along a guide roller 65. A winding roll 52 is driven by an ink motor 51 and transfer gears 64, whereby the ink sheet 58 is wound around the winding roll 52. When the present invention is applied to this serial printer, the drive voltage or drive current of the carriage motor 60 may be measured in stead of the drive voltage or current of the paper-transfer motor, which has been measured in the first to fifth embodiments.

As apparent from the foregoing description, in the ink sheet transfer control apparatus of the first embodiment, when the ink sheet transfer DC motor is driven with a specified ink sheet drive voltage, the measuring means measures either a recording paper drive voltage with which the first control means drives and controls the recording paper transfer DC motor, or a recording paper transfer motor current flowing through the recording paper transfer DC motor. Then, the relational expression determining means determines such a relational expression between the ink sheet drive voltage and the recording paper drive voltage that a specified tension is developed to the ink sheet, or such a relational expression between the ink sheet drive voltage and the recording paper transfer motor current that a specified tension is developed to the ink sheet, from a specified ink sheet drive voltage and a recording paper drive voltage or a recording paper transfer motor current. Further, the second control means substitutes a predetermined target recording paper drive voltage or recording paper transfer motor current into the relational expression, to thereby calculate such an ink sheet drive voltage that the recording paper transfer DC motor is driven with the target recording paper drive voltage or such an ink sheet drive voltage that the target recording paper transfer motor current is made to flow through the recording paper transfer DC motor. As a result, the ink sheet transfer DC motor is driven with the calculated ink sheet drive voltage.

In other words, in the first embodiment, from a specified ink sheet drive voltage and a recording paper drive voltage or recording paper transfer motor current measured in correspondence to the specified ink sheet drive voltage, such a relational expression that a specified tension is developed to the ink sheet is determined. Then, a desired target drive voltage or current of the recording paper transfer DC motor is substituted into the relational expression, whereby an ink sheet drive voltage to be applied to the ink sheet transfer DC motor is calculated.

As seen above, in the first embodiment, such a relational expression that a specified tension is developed to the ink sheet is determined by measuring a recording paper drive voltage or recording paper transfer motor current corresponding to a specified ink sheet drive voltage. Then, based on the relational expression, an ink sheet drive voltage corresponding to a target recording paper transfer DC motor drive voltage or recording paper transfer motor current can be derived. Therefore, the tension of the ink sheet can be set to a specified value without requiring any complex structure as in pulse generators, so that the ink sheet can be transferred stably and therefore the print grade can be improved.

In the second embodiment, when the ink sheet transfer DC motor is driven with a specified first ink sheet drive voltage, the first measuring means measures a first recording paper current flowing through the recording paper transfer DC motor controlled by the first control means. Next, when the ink sheet transfer DC motor is driven with a second ink sheet drive voltage, the second measuring means measures a second recording paper current flowing through the recording paper transfer DC motor controlled by the first control means. Then, the relational expression determining means determines such a relational expression between the ink sheet drive voltage and the recording paper current that a specified tension is developed to the ink sheet, from the first and second ink sheet drive voltages and the first and second recording paper currents. Further, the second control means substitutes a predetermined target recording paper drive voltage or a target recording paper current into the relational expression, to thereby calculate such an ink sheet drive voltage that the recording paper transfer DC motor is driven with the target recording paper drive voltage or such an ink sheet drive voltage that the target recording paper current is made to flow through the recording paper transfer DC motor. As a result, the ink sheet transfer DC motor is driven with the calculated ink sheet drive voltage.

In other words, in the second embodiment, such a relational expression that a specified tension is developed to the ink sheet is determined from the first and second ink sheet drive voltages and the first and second recording paper currents measured in correspondence to the first and second ink sheet drive voltages. Then, a desired target recording paper drive voltage or recording paper current is substituted into the relational expression, whereby an optimum ink sheet drive voltage to be applied to the ink sheet transfer DC motor is calculated.

As seen above, in the second embodiment, such a relational expression that a specified tension is developed to the ink sheet is determined by measuring two recording paper currents corresponding to specified two different ink sheet drive voltages. Then, based on the relational expression, the ink sheet drive voltage corresponding to a target recording paper drive voltage or a target recording paper current can be calculated. Therefore, the tension of the ink sheet can be set to a specified value without requiring any complex structure as in pulse generators, so that the ink sheet can be transferred stably and therefore the print grade can be improved.

Also, in the second embodiment, since the target driving force of the recording paper transfer DC motor is calculated from the current flowing through the recording paper transfer DC motor, the driving force of the recording paper transfer DC motor can be calculated without being affected by any deterioration of the recording paper transfer DC motor. Therefore, according to the second embodiment, the ink sheet can be transferred stably even if the recording paper transfer DC motor has deteriorated, so that the print grade can be maintained good.

Also, in the second embodiment, since the only data to be measured is the value of a current flowing through the grid motor, i.e., the recording paper transfer DC motor, the apparatus construction can be simplified and moreover the time required to calculate the optimum ink sheet drive voltage can be shortened.

In the third embodiment, with the ink sheet and the recording paper sandwiched by the print head and the platen into press contact with each other, while the first control means is controlling the recording paper transfer DC motor so that the recording paper is transferred at a constant speed, the first measuring means drives the ink sheet transfer DC motor with a specified first ink sheet drive voltage. Then, during this operation, the first measuring means measures a first recording paper drive voltage with which the first control means is driving and controlling the recording paper transfer DC motor, and a first recording paper current flowing through the recording paper transfer DC motor. Further, the deterioration constant calculating means calculates a deterioration constant of the recording paper transfer DC motor from the first recording paper drive voltage and the first recording paper current. Then, the recording paper drive voltage calculating means corrects the target value of the recording paper drive voltage, i.e., the target recording paper drive voltage, by an extent corresponding to the deterioration of the DC motor, which is a recording paper transfer means, represented by the deterioration constant. The second measuring means drives the ink sheet transfer DC motor with a specified second ink sheet drive voltage and measures a second recording paper drive voltage. Then, the relational expression determining means determines such a relational expression between the ink sheet drive voltage and the recording paper drive voltage that a specified tension is developed to the ink sheet, from the first and second ink sheet drive voltages and the first and second recording paper drive voltages. Then, the second control means substitutes the corrected target recording paper drive voltage into the relational expression to thereby calculate such an ink sheet drive voltage that the recording paper transfer DC motor is driven with the corrected target recording paper drive voltage. As a result, the second control means drives the ink sheet transfer DC motor with the resulting ink sheet drive voltage.

As seen above, in the third embodiment, such a relational expression that a specified tension is developed to the ink sheet is determined by measuring two recording paper drive voltages corresponding to specified two different ink sheet drive voltages, and based on the relational expression, the ink sheet drive voltage corresponding to a target recording paper drive voltage can be calculated. Therefore, the tension of the ink sheet can be set to a specified value without requiring any complex structure as in pulse generators, so that the ink sheet can be transferred stably and therefore the print grade can be improved. Also, in the third embodiment, since the target recording paper drive voltage is corrected by detecting a deterioration of the recording paper transfer DC motor, the ink sheet can be transferred stably at all times in response to any deterioration of the recording paper transfer DC motor.

Further, the first control means controls the recording paper transfer DC motor generally by controlling the drive voltage of the recording paper transfer DC motor. Accordingly, the drive voltage of the recording paper transfer DC motor can be measured with simplicity and high accuracy. As a result, the measurement of the drive voltage of the recording paper transfer DC motor, which is performed for calculating an optimum ink sheet transfer DC motor drive voltage as in the third embodiment, can be accomplished with simplicity and high accuracy. Accordingly, the accuracy of calculating the optimum ink sheet drive voltage can be improved.

Further, in the third embodiment, the time for the grid motor to be replaced with another can be known by calculating the deterioration constant of the grid motor, i.e., the recording paper transfer DC motor from the measured voltage and current values of the grid motor. Also, since the measurement of current value is performed once, the time required for measurement can be shortened.

As seen above, according to the first to third embodiments, the print drive system can be controlled with simple construction without adding any synchronous pulse generator or constant-torque mechanism or the like to the ink sheet drive system. Particularly in the second and third embodiments, the recording paper drive system and the ink sheet drive system are controlled integrally, whereby the transfer control in printing operation can be performed without being affected by any change in the winding radius of the ink sheet or by any deterioration of the drive system of the ink sheet and the recording paper. As a result, the print grade is never damaged.

In the fourth embodiment, with the recording paper and the ink sheet out of press contact with each other by the print head and the platen, when the recording paper transfer DC motor is driven with a specified voltage, the current measuring means measures the current flowing through the recording paper transfer DC motor at that time. Then, the recording paper transfer force calculation-formula correcting means detects a change in the transfer ability of the driving force transfer system contained in the recording paper transfer means, based on the current value measured by the current measuring means, and corrects the calculation formula for calculating the transfer force of the recording paper transfer means from the recording paper drive voltage or the recording paper current, in response to the change in the transfer ability. Further, the relational expression determining means determines such a relational expression between the ink sheet drive voltage and the recording paper drive voltage that a specified tension is developed to the ink sheet, by using the calculation formula corrected by the recording paper transfer force calculation-formula correcting means. Therefore, according to the fourth embodiment, at all times a specified tension can be developed to the ink sheet in correspondence to a change in the transfer ability of the driving force transfer system contained in the recording paper transfer means, so that a stable transfer of the ink sheet can be accomplished. That is, according to the fourth embodiment, in addition to the advantages of the first, second, and third embodiments, the transfer control in printing operation can be performed without any effect of the recording paper drive system due to some environmental change, by measuring the current flowing through the grid motor in the transfer of the recording paper with a constant drive voltage which can be attributed only to the grid motor, i.e., the recording paper transfer DC motor.

In the fifth embodiment, in the ink sheet transfer control apparatus as described in the second or third embodiment, the first recording paper current and a target recording paper current corresponding to a predetermined target recording paper transfer force are compared with each other. Then, the second measuring means is controlled in such a way that if the first recording paper current is greater than the target recording paper current, then the second ink sheet drive voltage is set larger than the first ink sheet drive voltage, and that if the first recording paper current is smaller than the target recording paper current, then the second ink sheet drive voltage is set smaller than the first ink sheet drive voltage. Therefore, according to the fifth embodiment, the measured first recording paper current can be utilized in setting the second ink sheet drive voltage. That is, according to the fifth embodiment, the second ink sheet drive voltage can be made closer to the optimum ink sheet drive voltage than the first ink sheet drive voltage can. As a result, according to the fifth embodiment, until the optimum driving force for the ink motor or ink sheet transfer DC motor is calculated, the ink sheet can be prevented from being transferred unstably.

In other words, according to the fifth embodiment, in addition to the advantages of the second or third embodiment, the second drive voltage of the ink sheet transfer DC motor is determined by the current value of the recording paper transfer DC motor measured when the motor is driven with the first voltage. Accordingly, the tension of the ink sheet due to the second drive voltage can be prevented from exceeding such a range as will not affect the print grade.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink sheet transfer control apparatus having a print head for transferring ink applied to an ink sheet onto recording paper, a platen opposing the print head for sandwiching the ink sheet and the recording paper between the platen and the print head, an ink sheet transfer means for transferring the ink sheet, and a recording paper transfer means for transferring the recording paper, the ink sheet transfer means including an ink sheet transfer DC motor, and the recording paper transfer means including a recording paper transfer DC motor, the ink sheet transfer control apparatus comprising:

first control means for controlling the recording paper transfer means so that the recording paper is transferred at a constant speed, with the ink sheet and the recording paper pinched by the print head and the platen into pressing contact with each other;

measuring means for measuring a recording paper drive voltage with which the first control means is driving and controlling the recording paper transfer DC motor, when the ink sheet transfer DC motor is driven with a specified ink sheet drive voltage;

relational expression determining means for determining such a relational expression between the ink sheet drive voltage and the recording paper drive voltage that a specified tension is developed to the ink sheet, from the specified ink sheet drive voltage with which the ink sheet transfer DC motor is driven, and the recording paper drive voltage with which the recording paper transfer DC motor is driven; and second control means for substituting a predetermined target recording paper drive voltage into the relational expression, to thereby calculate such an ink sheet drive voltage that the recording paper transfer DC motor is driven with the target recording paper drive voltage, whereby the ink sheet transfer DC motor is driven with the calculated ink sheet drive voltage.

2. The ink sheet transfer control apparatus according to claim 1, further comprising:

current measuring means for measuring a current flowing through the recording paper transfer DC motor when the recording paper transfer DC motor is driven with a specified voltages with the recording paper and the ink sheet out of pressing contact with each other by the print head and the platen; and recording paper transfer force calculation-formula correcting means for detecting a change in transfer ability of a driving force transfer system contained in the recording paper transfer means, based on a value of the current measured by the current measuring means, and correcting a calculation formula for calculating the transfer force of the recording paper transfer means from the drive voltage of the recording paper transfer DC motor or the current flowing through the recording paper transfer DC motor, in response to the change in the transfer ability, wherein the relational expression determining means determines such a relational expression between the ink sheet drive voltage and the recording paper drive voltage that a specified tension is developed to the ink sheet, by using the calculation formula corrected by the recording paper transfer force calculation-formula correcting means.

3. The ink sheet transfer control apparatus according to claim 1, wherein the ink sheet transfer means winds up the ink sheet.

4. An ink sheet transfer control apparatus having a print head for transferring ink applied to a ink sheet onto recording paper, a platen opposing the print head for sandwiching the ink sheet and the recording paper between the platen and the print head, an ink sheet transfer means for transferring the ink sheet, and a recording paper transfer means for transferring the recording paper, the ink sheet transfer means including an ink sheet transfer DC motor, and the recording paper transfer means including a recording paper transfer DC motor, the ink sheet transfer control apparatus comprising:

first control means for controlling the recording paper transfer means so that the recording paper is transferred at a constant speed, with the ink sheet and the recording paper pinched by the print head and the platen into pressing contact with each other;

first measuring means for measuring a first recording paper current flowing through the recording paper transfer DC motor driven and controlled by the first control means, when the ink sheet transfer DC motor is driven with a specified first ink sheet drive voltage;

second measuring means for measuring a second recording paper current flowing through the recording paper transfer DC motor driven and controlled by the first control means, when the ink sheet transfer DC motor is driven with a specified second ink sheet drive voltage;

relational expression determining means for determining such a relational expression between the ink sheet drive voltage and the recording paper current that a specified tension is developed to the ink sheet, from the first and second ink sheet drive voltages and the first and second recording paper currents; and second control means for substituting a predetermined target recording paper drive voltage into the relational expression, to thereby calculate such an ink sheet drive voltage that the recording paper transfer DC motor is driven with the target recording paper drive voltage, whereby the ink sheet transfer DC motor is driven with the calculated ink sheet drive voltage.

5. The ink sheet transfer control apparatus according to claim 2, further comprising:

current measuring means for measuring a current flowing through the recording paper transfer DC motor when the recording paper transfer DC motor is driven with a specified voltage, with the recording paper and the ink sheet out of pressing contact with each other by the print head and the platen; and recording paper transfer force calculation-formula correcting means for detecting a change in transfer ability of a driving force transfer system contained in the recording paper transfer means, based on a value of the current measured by the current measuring means, and correcting a calculation formula for calculating the transfer force of the recording paper transfer means from the drive voltage of the recording paper transfer DC motor or the current flowing through the recording paper transfer DC motor, in response to the change in the transfer ability, wherein the relational expression determining means determines such a relational expression between the ink sheet drive voltage and the recording paper drive voltage that a specified tension is developed to the ink sheet, by using the calculation formula corrected by the recording paper transfer force calculation-formula correcting means.

6. The ink sheet transfer control apparatus according to claim 4, further comprising:

measurement control means for comparing the first recording paper current and a target recording paper current corresponding to a predetermined target recording paper transfer force with each other, and controlling the second measuring means in such a way that if the first recording paper current is greater than the target recording paper current, then the second ink sheet drive voltage is set larger than the first ink sheet drive voltage, and that if the first recording paper current is smaller than the target recording paper current, then the second ink sheet drive voltage is set smaller than the first ink sheet drive voltage.

7. The ink sheet transfer control apparatus according to claim 4, wherein the ink sheet transfer means winds up the ink sheet.

8. An ink sheet transfer control apparatus having a print head for transferring ink applied to an ink sheet onto recording paper, a platen opposing the print head for sandwiching the ink sheet and the recording paper between the platen and the print head, an ink sheet transfer means for transferring the ink sheet, and a recording paper transfer means for transferring the recording paper, the ink sheet transfer means including an ink sheet transfer DC motor, and the recording paper transfer means including a recording paper transfer DC motor, the ink sheet transfer control apparatus comprising:

first control means for controlling the recording paper transfer means so that the recording paper is transferred at a constant speed, with the ink sheet and the recording paper pinched by the print head and the platen into pressing contact with each other;

first measuring means for measuring a first recording paper drive voltage with which the first control means is driving and controlling the recording paper transfer DC motor and a first recording paper transfer current flowing through the recording paper transfer DC motor, when the ink sheet transfer DC motor is driven with a specified first ink sheet drive voltage;

deterioration constant calculating means for calculating a deterioration constant of the recording paper transfer DC motor from the first recording paper drive voltage and the first recording paper current;

target recording paper drive voltage correcting means for correcting a predetermined target recording paper drive voltage by an extent corresponding to a deterioration of the DC motor represented by the deterioration constant;

second measuring means for measuring a second recording paper drive voltage with which the first control means is driving and controlling the recording paper transfer DC motor, when the ink sheet transfer DC motor is driven with a specified second ink sheet drive voltage;

relational expression determining means for determining such a relational expression between the ink sheet drive voltage and the recording paper drive voltage that a specified tension is developed to the ink sheet, from the first and second ink sheet drive voltages and the first and second recording paper drive voltages; and second control means for substituting the target recording paper drive voltage corrected by the target recording paper drive voltage correcting means, into the relational expression determined by the relational expression determining means, to thereby calculate such an ink sheet drive voltage that the recording paper transfer DC motor is driven with the corrected target recording paper drive voltage, whereby the ink sheet transfer DC motor is driven with the calculated ink sheet drive voltage.

9. The ink sheet transfer control apparatus according to claim 8, further comprising:

current measuring means for measuring a current flowing through the recording paper transfer DC motor when the recording paper transfer DC motor is driven with a specified voltage, with the recording paper and the ink sheet out of pressing contact with each other by the print head and the platen; and recording paper transfer force calculation-formula correcting means for detecting a change in transfer ability of a driving force transfer system contained in the recording paper transfer means, based on a value of the current measured by the current measuring means, and correcting a calculation formula for calculating the transfer force of the recording paper transfer means from the drive voltage of the recording paper transfer DC motor or the current flowing through the recording paper transfer DC motor, in response to the change in the transfer ability, wherein the relational expression determining means determines such a relational expression between the ink sheet drive voltage and the recording paper drive voltage that a specified tension is developed to the ink sheet, by using the calculation formula corrected by the recording paper transfer force calculation-formula correcting means.

10. The ink sheet transfer control apparatus according to claim 8, further comprising:

measurement control means for comparing the first recording paper current and a target recording paper current corresponding to a predetermined target recording paper transfer force with each other, and controlling the second measuring means in such a way that if the first recording paper current is greater than the target recording paper current, then the second ink sheet drive voltage is set larger than the first ink sheet drive voltage, and that if the first recording paper current is smaller than the target recording paper current, then the second ink sheet drive voltage is set smaller than the first ink sheet drive voltage.

11. The ink sheet transfer control apparatus according to claim 8, wherein the ink sheet transfer means winds up the ink sheet.

12. An ink sheet transfer control apparatus having a print head for transferring ink applied to an ink sheet onto recording paper, a platen opposing the print head for sandwiching the ink sheet and the recording paper between the platen and the print head, an ink sheet transfer means for transferring the ink sheet, and a recording paper transfer means for transferring the recording paper, the ink sheet transfer means including an ink sheet transfer DC motor, and the recording paper transfer means including a recording paper transfer DC motor, the ink sheet transfer control apparatus comprising:

first control means for controlling the recording paper transfer means so that the recording paper is transferred at a constant speed, with the ink sheet and the recording paper pinched by the print head and the platen into pressing contact with each other;

measuring means for measuring a recording paper transfer motor current flowing through the recording paper transfer DC motor, when the ink sheet transfer DC motor is driven with a specified ink sheet drive voltage;

relational expression determining means for determining such a relational expression between the ink sheet drive voltage and the recording paper transfer motor current that a specified tension is developed to the ink sheet, from the specified ink sheet drive voltage with which the ink sheet transfer DC motor is driven, and the recording paper transfer motor current with which the recording paper transfer DC motor is driven; and second control means for substituting a predetermined target recording paper transfer motor current into the relational expression, to thereby calculate such an ink sheet drive voltage that the target recording paper transfer motor current is made to flow through the recording paper transfer DC motor, whereby the ink sheet transfer DC motor is driven with the calculated ink sheet drive voltage.

13. The ink sheet transfer control apparatus according to claim 12, further comprising:

current measuring means for measuring a current flowing through the recording paper transfer DC motor when the recording paper transfer DC motor is driven with a specified voltage, with the recording paper and the ink sheet out of pressing contact with each other by the print head and the platen; and recording paper transfer force calculation-formula correcting means for detecting a change in transfer ability of a driving force transfer system contained in the recording paper transfer means, based on a value of the current measured by the current measuring means, and correcting a calculation formula for calculating the transfer force of the recording paper transfer means from the drive voltage of the recording paper transfer DC motor or the current flowing through the recording paper transfer DC motor, in response to the change in the transfer ability, wherein the relational expression determining means determines such a relational expression between the ink sheet drive voltage and the recording paper drive voltage that a specified tension is developed to the ink sheet, by using the calculation formula corrected by the recording paper transfer force calculation-formula correcting means.

14. A sheet transfer control apparatus for transferring a sheet and a paper, including a sheet transfer means for transferring the sheet and a paper transfer means for transferring the paper, the sheet transfer means including a sheet transfer DC motor, and the paper transfer means including a paper transfer DC motor, the sheet transfer control apparatus comprising:

first control means for controlling the paper transfer means so that the paper is transferred at a constant speed;

measuring means for measuring a paper drive voltage with which the first control means is driving and controlling the paper transfer DC motor or a paper transfer motor current flowing through the paper transfer DC motor, when the sheet transfer DC motor is driven with a specified sheet drive voltage;

relational expression determining means for determining such a relational expression between the sheet drive voltage and the paper drive voltage or the paper transfer motor current that a specified tension is developed to the sheet, from the specified sheet drive voltage with which the sheet transfer DC motor is driven, and the paper drive voltage or paper transfer motor current with which the paper transfer DC motor is driven; and second control means for substituting a predetermined target paper drive voltage or paper transfer motor current into the relational expression, to thereby calculate such a sheet drive voltage that the paper transfer DC motor is driven with the target paper drive voltage or such a sheet drive voltage that the target paper transfer motor current is made to flow through the paper transfer DC motor, whereby the sheet transfer DC motor is driven with the calculated sheet drive voltage.

15. The ink sheet transfer control apparatus according to claim 14, further comprising:

current measuring means for measuring a current flowing through the paper transfer DC motor when the paper transfer DC motor is driven with a specified voltage; and paper transfer force calculation-formula correcting means for detecting a change in transfer ability of a driving force transfer system contained in the paper transfer means, based on a value of the current measured by the current measuring means, and correcting a calculation formula for calculating the transfer force of the paper transfer means from the drive voltage of the paper transfer DC motor or the current flowing through the paper transfer DC motor, in response to the change in the transfer ability, wherein the relational expression determining means determines such a relational expression between the sheet drive voltage and the paper drive voltage that a specified tension is developed to the sheet, by using the calculation formula corrected by the paper transfer force calculation-formula correcting means.

16. A sheet transfer control apparatus for transferring a sheet and a paper, including a sheet transfer means for transferring the sheet and a paper transfer means for transferring the paper, the sheet transfer means including a sheet transfer DC motor, and the paper transfer means including a paper transfer DC motor, the sheet transfer control apparatus comprising:

first control means for controlling the paper transfer means so that the paper is transferred at a constant speed;

first measuring means for measuring a first paper current flowing through the paper transfer DC motor driven and controlled by the first control means, when the sheet transfer motor is driven with a specified first sheet drive voltage;

second measuring means for measuring a second paper current flowing through the paper transfer DC motor driven and controlled by the first control means, when the sheet transfer DC motor is driven with a specified second sheet drive voltage;

relational expression determining means for determining such a relational expression between the sheet drive voltage and the paper current that a specified tension is developed to the sheet, from the first and second sheet drive voltages and the first and second paper currents; and second control means for substituting a predetermined target paper drive voltage into the relational expression, to thereby calculate such a sheet drive voltage that the paper transfer DC motor is driven with the target paper drive voltage, whereby the sheet transfer DC motor is driven with the calculated sheet drive voltage.

17. The sheet transfer control apparatus according to claim 16, further comprising:

current measuring means for measuring a current flowing through the paper transfer DC motor when the paper transfer DC motor is driven with a specified voltage; and paper transfer force calculation-formula correcting means for detecting a change in transfer ability of a driving force transfer system contained in the paper transfer means, based on a value of the current measured by the current measuring means, and correcting a calculation formula for calculating the transfer force of the paper transfer means from the drive voltage of the paper transfer DC motor or the current flowing through the paper transfer DC motor, in response to the change in the transfer ability, wherein the relational expression determining means determines such a relational expression between the sheet drive voltage and the paper drive voltage that a specified tension is developed to the sheet, by using the calculation formula corrected by the paper transfer force calculation-formula correcting means.

18. The ink sheet transfer control apparatus according to claim 16, further comprising:

measurement control means for comparing the first paper current and a target paper current corresponding to a predetermined target paper transfer force with each other, and controlling the second measuring means in such a way that if the first paper current is greater than the target paper current, then the second sheet drive voltage is set larger than the first sheet drive voltage, and that if the first paper current is smaller than the target paper current, then the second sheet drive voltage is set smaller than the first sheet drive voltage.

19. A sheet transfer control apparatus for transferring a sheet and a paper, including a sheet transfer means for transferring the sheet and a paper transfer means for transferring the paper, the sheet transfer means including a sheet transfer DC motor, and the paper transfer means including a paper transfer DC motor, the sheet transfer control apparatus comprising:

first control means for controlling the paper transfer means so that the paper is transferred at a constant speed;

first measuring means for measuring a first paper drive voltage with which the first control means is driving and controlling the paper transfer DC motor and a first paper transfer current flowing through the paper transfer DC motor, when the sheet transfer DC motor is driven with a specified first sheet drive voltage;

deterioration constant calculating means for calculating a deterioration constant of the paper transfer DC motor from the first paper drive voltage and the first paper current;

target paper drive voltage correcting means for correcting a predetermined target paper drive voltage by an extent corresponding to a deterioration of the DC motor represented by the deterioration constant;

second measuring means for measuring a second paper drive voltage with which the first control means is driving and controlling the paper transfer DC motor, when the sheet transfer DC motor is driven with a specified second sheet drive voltage;

relational expression determining means for determining such a relational expression between the sheet drive voltage and the paper drive voltage that a specified tension is developed to the sheet, from the first and second sheet drive voltages and the first and second paper drive voltages; and second control means for substituting the target paper drive voltage corrected by the target paper drive voltage correcting means, into the relational expression determined by the relational expression determining means, to thereby calculate such a sheet drive voltage that the paper transfer DC motor is driven with the corrected target paper drive voltage, whereby the sheet transfer DC motor is driven with the calculated sheet drive voltage.

20. The sheet transfer control apparatus according to claim 19, further comprising:

current measuring means for measuring a current flowing through the paper transfer DC motor when the paper transfer DC motor is driven with a specified voltage; and paper transfer force calculation-formula correcting means for detecting a change in transfer ability of a driving force transfer system contained in the paper transfer means, based on a value of the current measured by the current measuring means, and correcting a calculation formula for calculating the transfer force of the paper transfer means from the drive voltage of the paper transfer DC motor or the current flowing through the paper transfer DC motor, in response to the change in the transfer ability, wherein the relational expression determining means determines such a relational expression between the sheet drive voltage and the paper drive voltage that a specified tension is developed to the sheet, by using the calculation formula corrected by the paper transfer force calculation-formula correcting means.

21. The ink sheet transfer control apparatus according to claim 19, further comprising:

measurement control means for comparing the first paper current and a target paper current corresponding to a predetermined target paper transfer force with each other, and controlling the second measuring means in such a way that if the first paper current is greater than the target paper current, then the second sheet drive voltage is set larger than the first sheet drive voltage, and that if the first paper current is smaller than the target paper current, then the second sheet drive voltage is set smaller than the first sheet drive voltage.

* * * * *